US011577868B2

(12) United States Patent
Broek et al.

(10) Patent No.: US 11,577,868 B2
(45) Date of Patent: Feb. 14, 2023

(54) PACKAGING MACHINE FOR PRODUCING CIGARETTE PACKS

(71) Applicant: Focke & Co. (GmbH & Co. KG), Verden (DE)

(72) Inventors: Holger Broek, Kirchlinteln (DE); Burkard Roesler, Blender (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 0 days.

(21) Appl. No.: 16/770,567

(22) PCT Filed: Dec. 6, 2018

(86) PCT No.: PCT/EP2018/083791

§ 371 (c)(1),
(2) Date: Jun. 5, 2020

(87) PCT Pub. No.: WO2019/110729

PCT Pub. Date: Jun. 13, 2019

(65) Prior Publication Data

US 2021/0163163 A1 Jun. 3, 2021

(30) Foreign Application Priority Data

Dec. 8, 2017 (DE) ..... 102017011310.6

(51) Int. Cl.
*B65B 19/02* (2006.01)
*B65D 85/10* (2006.01)
(Continued)

(52) U.S. Cl.
CPC ..... *B65B 19/02* (2013.01); *B65B 19/025* (2013.01); *B65B 19/20* (2013.01); *B65B 35/58* (2013.01);
(Continued)

(58) Field of Classification Search
CPC ..... B65B 19/025; B65B 19/20; B65B 35/58; B65B 2220/02; B65B 2230/04;
(Continued)

(56) References Cited

U.S. PATENT DOCUMENTS

2005/0082012 A1* 4/2005 Spatafora ..... B65C 9/0015 156/567
2006/0076111 A1* 4/2006 Spatafora ..... B65C 9/1884 156/569
(Continued)

FOREIGN PATENT DOCUMENTS

CN 86103037 A 1/1987
CN 102112378 A 6/2011
(Continued)

OTHER PUBLICATIONS

WIPO, International Search Report (on the parent application), dated Apr. 1, 2019.
(Continued)

*Primary Examiner* — Anna K Kinsaul
*Assistant Examiner* — Luis G Del Valle
(74) *Attorney, Agent, or Firm* — Laurence P. Colton; Smith Tempel Blaha LLC

(57) ABSTRACT

A packaging machine for producing packs containing a group of cigarettes, having in a manufacturing flow direction: a forming unit for forming cigarette groups; a first folding unit at which an inner blank composed of a material suitable for forming a dimensionally stable inner pack is folded around a cigarette group to form an inner pack with the cigarette group as pack content; adjoining said first folding unit, a sealing inner pack unit in which a sealing inner pack is manufactured from the inner pack, the sealing inner pack is folded into a final state, or one sealing inner pack comprising the inner pack is manufactured; and adjoin-
(Continued)

ing the sealing inner pack unit, a second folding unit at which an outer blank composed of a material suitable for forming a dimensionally stable outer pack is folded around the sealing inner pack to form an outer pack.

31 Claims, 10 Drawing Sheets

(51) Int. Cl.
*B65B 19/20* (2006.01)
*B65B 35/58* (2006.01)

(52) U.S. Cl.
CPC ... *B65D 85/1045* (2013.01); *B65D 85/10568* (2020.05); *B65B 2220/02* (2013.01); *B65B 2230/04* (2013.01)

(58) Field of Classification Search
CPC ... B65B 19/02; B65B 19/04; B65B 19/12–20; B65B 9/12; B65B 5/10; B65B 5/101; B65B 43/52
USPC ..... 131/368, 369
See application file for complete search history.

(56) References Cited

U.S. PATENT DOCUMENTS

| | | | | |
|---|---|---|---|---|
| 2006/0260756 | A1* | 11/2006 | Spatafora | B65C 1/023 156/539 |
| 2007/0101683 | A1* | 5/2007 | Bray | B65B 19/20 53/462 |
| 2007/0144546 | A1* | 6/2007 | Spatafora | B65B 19/28 131/904 |
| 2008/0202681 | A1* | 8/2008 | Spatafora | B65C 1/042 156/308.2 |
| 2011/0114518 | A1* | 5/2011 | Hein | B65B 19/20 206/268 |
| 2015/0329227 | A1* | 11/2015 | Collins | B65B 51/04 53/415 |
| 2017/0283150 | A1* | 10/2017 | Petrucci | B65B 11/004 |
| 2017/0334634 | A1* | 11/2017 | Bray | B65B 51/02 |
| 2019/0352041 | A1* | 11/2019 | Polloni | B65D 85/1045 |
| 2020/0010226 | A1* | 1/2020 | Draghetti | B29C 66/8432 |

FOREIGN PATENT DOCUMENTS

| | | | |
|---|---|---|---|
| CN | 102498046 | A | 6/2012 |
| CN | 104608950 | A | 5/2015 |
| CN | 206691424 | U | 12/2017 |
| DE | 19753019 | A1 | 6/1999 |
| DE | 102004009399 | A1 | 9/2005 |
| DE | 102008010433 | A1 | 8/2009 |
| DE | 102008035467 | A1 | 2/2010 |
| DE | 102009041900 | A1 | 4/2011 |
| DE | 102009060134 | A1 | 6/2011 |
| DE | 102011119344 | A1 | 4/2013 |
| DE | 102013009472 | A1 | 12/2014 |
| DE | 102015001311 | A1 | 8/2016 |
| DE | 102015001312 | A1 | 8/2016 |
| DE | 102016003737 | A1 | 10/2017 |
| DE | 102016004930 | A1 | 10/2017 |
| DE | 102016007827 | A1 | 11/2017 |
| DE | 102016012300 | A1 | 4/2018 |
| DE | 102016118581 | A1 | 4/2018 |
| WO | 2006032874 | A1 | 3/2006 |

OTHER PUBLICATIONS

Deutsches Patent-Und Markenamt (German Patent and Trademark Office), Recherchenbericht (search in a related application), Jul. 16, 2018.
China National Intellectual Property Administration, Notification of the First Office Action and Search Report, dated Apr. 19, 2021.

* cited by examiner

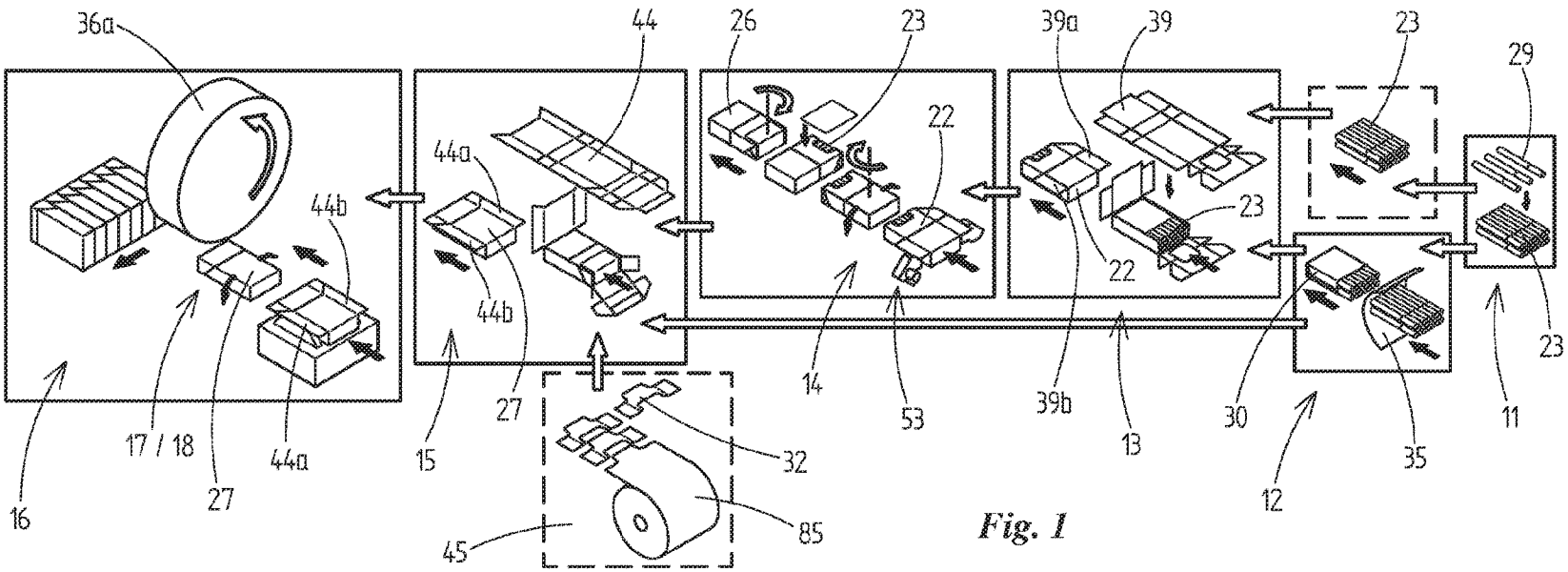
Fig. 1
Fig. 2
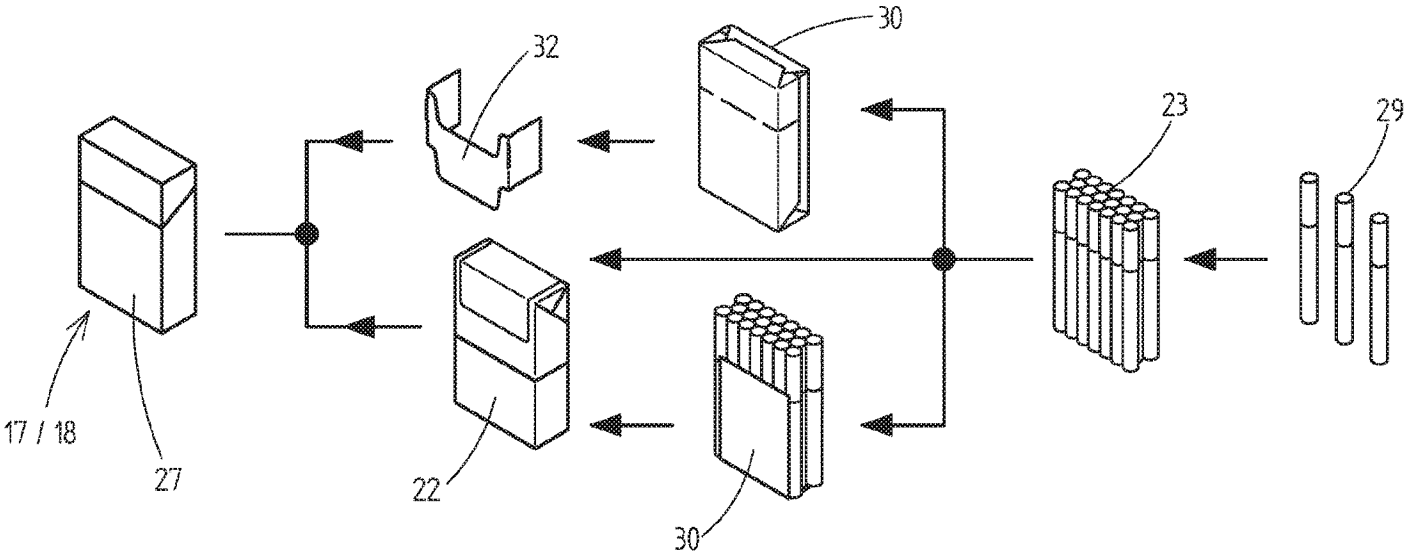

17
18
19
22
23
24
25
26
27
28
29
30
31
32
33

PACKAGING MACHINE FOR PRODUCING CIGARETTE PACKS

CROSS REFERENCE TO RELATED APPLICATIONS

This application is the US National Phase of and claims the benefit of and priority on International Application No. PCT/EP2018/083791 having a filing date of 6 Dec. 2018, which claims priority on and the benefit of German Patent Application No. 10 2017 011 310.6 having a filing date of 8 Dec. 2017.

BACKGROUND OF THE INVENTION

Technical Field

The present invention relates to a packaging machine for producing packs with a group of cigarettes as pack content. The invention furthermore relates to a method for producing such packs.

Prior Art

In the cigarette packaging sector, particular packs have been of interest for several years. On the one hand, packs in which the cigarette group is almost completely surrounded by a dimensionally stable inner wrapper other than in the region of removal opening, wherein the removal opening is covered by an in particular reclosable closure flap or a closure label. This inner pack is integrated into a likewise dimensionally stable outer wrapper, for example a hinged carton composed of cardboard. Such a pack is also referred to as a box-in-box pack. Packs have likewise aroused particular interest which, although they also have an inner pack or a tray composed of dimensionally stable material, said inner pack or tray is however in turn firstly integrated into a separate sealing inner pack composed of foil, wherein the sealing inner pack has a removal opening covered by a closure label. The sealing inner pack is in turn integrated in a separate, dimensionally stable outer pack.

BRIEF SUMMARY OF THE INVENTION

Taking this as a starting point, it is an object of the present invention to further develop a packaging machine of the type mentioned in the introduction. It is furthermore an object of the present invention to further develop a method of the type mentioned in the introduction.

Said object is achieved by means of a packaging machine for producing packs with a group of cigarettes as pack content, wherein the packaging machine has at least the following in succession in a manufacturing flow direction:

- a preferably separable forming unit for forming cigarette groups;
- a preferably separable first folding unit at which an inner blank composed of cardboard or of some other material suitable for forming a dimensionally stable (inner) pack is folded at least in certain regions around the respective cigarette group so as to form an inner pack with the cigarette group as pack content;
- in particular adjoining said first folding unit, a preferably separable sealing inner pack unit in which a sealing inner pack is manufactured in each case from the inner pack or in which the sealing inner pack is folded into a final state or in which in each case one sealing inner pack comprising the inner pack is manufactured; and

- in particular adjoining said sealing inner pack unit, a preferably separable second folding unit at which an outer blank composed of cardboard or of some other material suitable for forming a dimensionally stable (outer) pack is in each case folded around the sealing inner pack in each case so as to form an outer pack.

Said object also is achieved by means of a method for producing packs with a group of cigarettes as pack content, in particular in a packaging machine having the features disclosed herein, wherein,

- in a preferably separable forming unit for forming cigarette groups, cigarettes originating from a cigarette magazine are formed into cigarette groups, wherein,
- in a preferably separable first folding unit, an inner blank composed of cardboard or of some other material suitable for forming a dimensionally stable (inner) pack is folded at least in certain regions around the respective cigarette group so as to form an inner pack with the cigarette group as pack content, wherein,
- in a preferably separable sealing inner pack unit in particular adjoining said first folding unit, a sealing inner pack is manufactured in each case from the inner pack or in each case one sealing inner pack comprising the inner pack is manufactured or the sealing inner pack is folded into a final state, wherein,
- in a preferably separable second folding unit in particular adjoining said sealing inner pack unit, an outer blank composed of cardboard or of some other material suitable for forming a dimensionally stable (outer) pack is in each case folded around the sealing inner pack in each case so as to form an outer pack.

According to this, a packaging machine for producing packs with a group of cigarettes as pack content has at least the following in succession in a manufacturing flow direction, in particular in a first configuration, preferably arranged adjacent to one another on an in particular rectilinear manufacturing line:

- a preferably separable forming unit for forming cigarette groups,
- a preferably separable first folding unit at which an inner blank composed of cardboard or of some other material suitable for forming a dimensionally stable (inner) pack is folded at least in certain regions around the respective cigarette group so as to form an inner pack with the cigarette group as pack content,
- in particular adjoining said first folding unit, a preferably separable sealing inner pack unit in which a sealing inner pack is manufactured in each case from the inner pack or in which the sealing inner pack is folded into a final state or in which in each case one sealing inner pack comprising the inner pack is manufactured,
- in particular adjoining said sealing inner pack unit, a preferably separable second folding unit at which an outer blank composed of cardboard or of some other material suitable for forming a dimensionally stable (outer) pack is in each case folded around the sealing inner pack in each case so as to form an outer pack.

According to a preferred refinement of the invention, the packaging machine has, downstream of the preferably separable second folding unit in the manufacturing flow, and in particular adjoining said second folding unit, a preferably separable manufacturing unit—curing unit—in which adhesive arranged between folding tabs of the respective outer blank of the outer pack which have been adhesively bonded to one another can cure.

Here, "curing" is to be understood to mean all types of physical or chemical curing. These include, in the case of water or other solvent-containing adhesives, the drying thereof or, in the case of hotmelt adhesive, the setting thereof.

Preferably, the in particular separable manufacturing units of the packaging machine each have at least one dedicated servomotor or, alternatively, several of the in particular separable manufacturing units, in particular in each case at most two or three of the in particular separable manufacturing units, have a common servomotor for driving at least one movable member of the in particular separable manufacturing unit or of the manufacturing units, preferably for driving all movable members, which are to be driven, of the in particular separable manufacturing unit(s), in particular for driving at least one conveying member.

Preferably, at least two in particular separable manufacturing units are assigned in each case one common servomotor for driving movable members of the in particular separable manufacturing units, wherein only one of these in particular separable manufacturing units has the servomotor, and wherein at least one movable member of the in particular separable manufacturing unit which does not have the servomotor is connected via a transmission to the servomotor of the other, in particular separable manufacturing unit which has the servomotor.

Insofar as the manufacturing units are separable (this does not have to be the case according to the invention), they are (non-destructively) separable from one another in each case in the region of or along (imaginary) parting planes between them, and can be removed from the manufacturing line as required.

Preferably, the packaging machine according to the invention can in this case be converted from the first configuration presented above, in which a first type of pack can be manufactured, into a second configuration, in which a second type of pack which differs from the first type of pack can be manufactured, by removing at least one separable manufacturing unit from the manufacturing line, by replacing at least one separable manufacturing unit with another separable manufacturing unit and/or by adding at least one further separable manufacturing unit to the manufacturing line.

According to a preferred refinement of the invention, the packaging machine has, between the two folding units, a conveying device with an in particular rectilinear conveying path which conveys the respective cigarette group (integrated into the inner pack), in particular with cigarettes oriented parallel to the conveying direction, into the region of a turning device which is arranged between the first and second folding unit and which rotates the cigarette group in particular through 90° or 180°, preferably into or parallel to the conveying plane of the conveying device.

In a further preferred refinement of the invention, the conveying device which conveys the respective cigarette group to the turning device conveys the cigarette group downstream of the turning device to the second folding unit.

In a further preferred refinement of the invention, the turning device is designed so as to rotate the cigarette group about at least one axis of rotation which is arranged perpendicular to the cigarette longitudinal extent.

According to a further preferred refinement of the invention, the turning device has a first turning station, which rotates the respective cigarette group through a certain angle of rotation, in particular 90°, and, downstream of the first turning station, a second turning station, which rotates the cigarette group—either in the same direction of rotation or in the opposite direction of rotation in relation to the first turning station—through preferably the same angle of rotation, in particular 90°.

According to a further preferred refinement of the invention, the turning device, in particular each turning station, has, in the region of the conveying path of the conveying device, a motor-driven, rotatable holding member, the holding forces of which holding member can be activated and deactivated, in particular a suction member by means of which the respective pack into which the cigarette group is integrated as pack content (inner pack or sealing inner pack) can, in the held state, be withdrawn from the conveying engagement of the conveyor and, by rotation of the holding member, rotated relative to the conveying path.

According to a further preferred refinement of the invention, the conveying device has, to both sides of the conveying path, lateral guides with in each case one guide surface for the respectively conveyed cigarette group integrated into the inner or sealing inner pack, wherein the guide surfaces, at least in one section, run parallel with a spacing to one another and, in another section, delimit or form a turning location at which the rotation of the respective inner or sealing inner pack into which the cigarette group is integrated is performed by means of the holding member, wherein the guide surfaces have a greater spacing to one another in at least one section of the turning location than in a section immediately upstream or downstream of the turning location, in particular in each case adjoining the latter. The guide surfaces preferably each run outward in a curved manner in at least one section of the turning location.

According to a further preferred refinement of the invention, the guide surfaces have a greater spacing to one another in at least one section immediately downstream of the turning location, in particular adjoining the latter, than in a section immediately upstream of the turning location, in particular upstream of the turning location.

In a further preferred refinement of the invention, the turning device is a constituent part of the sealing inner pack unit.

In a further preferred refinement of the invention, the first folding unit and/or the second folding unit comprises a folding revolver which folds the inner blank around the cigarette group so as to form the inner pack and/or which folds the outer blank in each case around the sealing inner pack so as to form the outer pack.

In a further preferred refinement of the invention, the sealing inner pack unit has a labeling station at which a removal opening of the respective inner pack is provided or covered over its entire area with an openable (preferably reclosable) closure label so as to form the respective sealing inner pack.

In a further preferred refinement of the invention, the labeling station is arranged between the first and second turning stations.

In a further preferred refinement of the invention, the labeling station has a labeling apparatus with a label conveyor, in particular a suction conveyor, by means of which individual closure labels peeled off from a label carrier strip are conveyed, with a spacing to one another, to an application region in which the closure labels are applied individually and successively by the label conveyor directly onto the removal opening of the respective inner pack which is conveyed along the application region in particular in continuous fashion by the conveying device.

In a further preferred refinement of the invention, the vertical conveying plane of the label conveyor in the application region runs perpendicular to the in particular horizontal conveying plane of the respective inner pack.

In a further preferred refinement of the invention, the labeling apparatus has a peel-off station at which closure labels situated on a carrier strip and conveyed to the peel-off station are individually peeled off or detached from the carrier strip and transferred to the label conveyor.

In a further preferred refinement of the invention, the sealing inner pack unit has a first label folding member arranged downstream of the labeling station, in particular a motor-driven folding member or a stationary folding switch, by means of which at least one section of the closure label applied to the inner pack, in particular a section protruding from the inner pack laterally transversely with respect to the conveying path, is folded around the inner pack or folded onto a side of the inner pack.

In a further preferred refinement of the invention, the sealing inner pack unit has a second label folding member arranged downstream of the labeling station, in particular a motor-driven folding member or a stationary folding switch, by means of which at least one further, other section of the closure label applied to the inner pack is folded around the inner pack or folded onto a side of the inner pack so as to form the sealing inner pack.

In a further preferred refinement of the invention, one of the two label folding members folds a section of the closure label onto the top side of the inner pack, the other of the two label folding members folds a section of the closure label onto the rear side of the inner pack.

In a further preferred refinement of the invention, one label folding member or both label folding members are arranged between the two turning stations of the turning device.

In a further preferred refinement of the invention, in the region of the conveying path of the conveying device along which the respective inner pack is conveyed, in particular upstream of the first turning station, there is arranged a glue-applying unit for applying glue to at least one, preferably at least two side tabs, which have not yet been folded into a final state, of the inner pack.

In a further preferred refinement of the invention, in the region of the conveying path of the conveying device along which the respective inner pack is conveyed, in particular downstream of the glue-applying unit, there is arranged at least one folding member for folding at least one or the side tab, which has in particular had hot glue applied thereto and which has not been folded into a final state, preferably at least two folding members for folding at least two or both side tabs, which have in particular had hot glue applied thereto and which have not been folded into a final state, of the inner pack.

In a further preferred refinement of the invention, the at least one folding member or both folding members are arranged to the side of the conveying path and can be moved perpendicularly with respect to the conveying plane, in particular up and down.

In a further preferred refinement of the invention, the packaging machine has, in particular between the forming unit and the first folding unit, a preferably separable manufacturing unit—wrapping unit—in which a blank composed of wrapping material, in particular foil material or (coated) paper, such as tin foil or aluminum-laminated paper, is folded around the cigarette group so as to form a wrap which fully or partially surrounds the cigarette group.

In a further preferred refinement of the invention, the inner blank which is folded around the cigarette group in the first separable folding unit is, already before the folding process, provided with a closure label which is arranged so as to cover a removal opening of the subsequent sealing inner pack.

In a further preferred refinement of the invention, the packaging machine has an appliance which applies the closure labels to the individual inner blanks, and has a conveying device which conveys the individual labels provided with the closure labels to the first folding unit.

The method according to the invention for producing packs with a group of cigarettes as pack content, in particular in a packaging machine having the above features, comprises the following steps:

- in a preferably separable forming unit for forming cigarette groups, cigarettes originating from a cigarette reservoir are formed into cigarette groups,
- in a preferably separable first folding unit, an inner blank composed of cardboard or of some other material suitable for forming a dimensionally stable (inner) pack is folded at least in certain regions around the respective cigarette group so as to form an inner pack with the cigarette group as pack content,
- in a preferably separable sealing inner pack unit in particular adjoining said first folding unit, a sealing inner pack is manufactured in each case from the inner pack or in each case one sealing inner pack comprising the inner pack is manufactured or the sealing inner pack is folded into a final state,
- in a preferably separable second folding unit in particular adjoining said sealing inner pack unit, an outer blank composed of cardboard or of some other material suitable for forming a dimensionally stable (outer) pack is in each case folded around the sealing inner pack in each case so as to form an outer pack.

In a further preferred refinement of the invention, the respective cigarette group (integrated into the inner pack) is conveyed from the first folding unit to a turning device in which the cigarette group is rotated through a predetermined angle of rotation, in particular through 180°, preferably in two turning stations which are arranged in succession along the conveying path and in each of which an individual partial rotation through a partial angle of rotation is performed, the magnitude of which partial angle of rotation corresponds to the angle of the overall rotation divided by the number of partial rotations, in particular in each case 90°.

In a further preferred refinement of the invention, the respective cigarette group (integrated into the inner pack, or possibly later into the sealing inner pack) is conveyed from the first folding unit to a turning device in which the cigarette group is firstly rotated in a first partial rotation through a first angle of rotation in a first direction of rotation, in particular through 90°, and in which the cigarette group is subsequently rotated in a second partial rotation through a second angle of rotation of the same magnitude, in particular through 90°, but in a second direction of rotation which is opposite to the first direction of rotation.

In a further preferred refinement of the invention, the cigarette group is conveyed with cigarettes oriented parallel to the conveying direction, in particular such that the filters of the cigarettes are situated at the front or at the rear in the conveying direction.

Preferably, the orientation of the filters of the cigarettes of the cigarette group in the conveying direction is reversed if the turning device rotates the inner pack through 180°, such that filters of the cigarettes of the cigarette group that were previously situated at the front are subsequently situated at the rear in the conveying direction, and filters that were previously situated at the rear are correspondingly subsequently situated at the front.

In a further preferred refinement of the invention, the turning device, in particular each turning station, has, in the region of the conveying path of the conveying device, a rotatably driven holding member, the holding forces of which can be activated and deactivated, in particular a suction member which, for the rotation of the pack, temporarily holds the respective inner or sealing inner pack into which the cigarette group is integrated, wherein, for the process of rotation, the holding member firstly withdraws the pack, in the held state, from the conveying engagement of the conveyor and subsequently rotates the pack, in the held state, relative to the conveying path, in particular through 90°, preferably in the conveying plane in which the packs are conveyed by the conveying device, or parallel to said conveying plane.

In a further preferred refinement of the invention, the holding member, in order to withdraw the pack from the conveying engagement of the conveying device, at least intermittently has a speed in the conveying direction which is higher than the conveying speed of the conveying device.

In a further preferred refinement of the invention, before the process of rotation, the pack lies against a driver of the conveying device in the context of the conveying engagement, wherein, during the process of rotation at the turning station, the following method steps are performed in succession:

- the holding member and the pack are brought into a relative position in which the holding member is arranged above the pack,
- the holding member holds the pack so as to take the latter on,
- the holding member is moved, so as to drive the pack along, with a speed component (at least inter alia) in the conveying direction which exceeds the conveying speed of the conveying device or of the driver, such that the pack is removed from the driver and withdrawn from the engagement of the conveying device,
- the holding member is rotated together with the pack relative to the conveying path, in particular through 90°,
- the holding device releases the pack again in the region of the conveying path,
- the driver, in contact (again) with the pack, conveys the pack onward in the rotated orientation.

In a further preferred refinement of the invention, the turning device, in particular each turning station, has a stop which rotates together with the holding member and against which the respective inner or sealing inner pack abuts before the rotation of the holding member holding the respective inner or sealing inner pack is performed.

BRIEF DESCRIPTION OF THE DRAWINGS

Further features of the present invention will emerge from the appended patent claims and from the following description of preferred exemplary embodiments of the invention. In the figures:

FIG. 1 schematically shows main handling steps that take place in different configurations of an embodiment of the packaging machine according to the invention;

FIG. 2 is a schematic illustration of individual manufacturing steps of different pack types that can be manufactured in different configurations of the packaging machine;

DETAILED DESCRIPTION OF PREFERRED EMBODIMENTS

The packaging machine 10 described below for producing cigarette packs has individual separable manufacturing units 11-16 which are arranged adjacent to one another in a manufacturing line, cf. FIG. 7. Based on the separability of the individual manufacturing units, said packaging machine can assume different configurations. This however does not have to be the case according to the invention; in particular, the manufacturing units do not have to be separable from one another.

Figures 3, 4, 5:
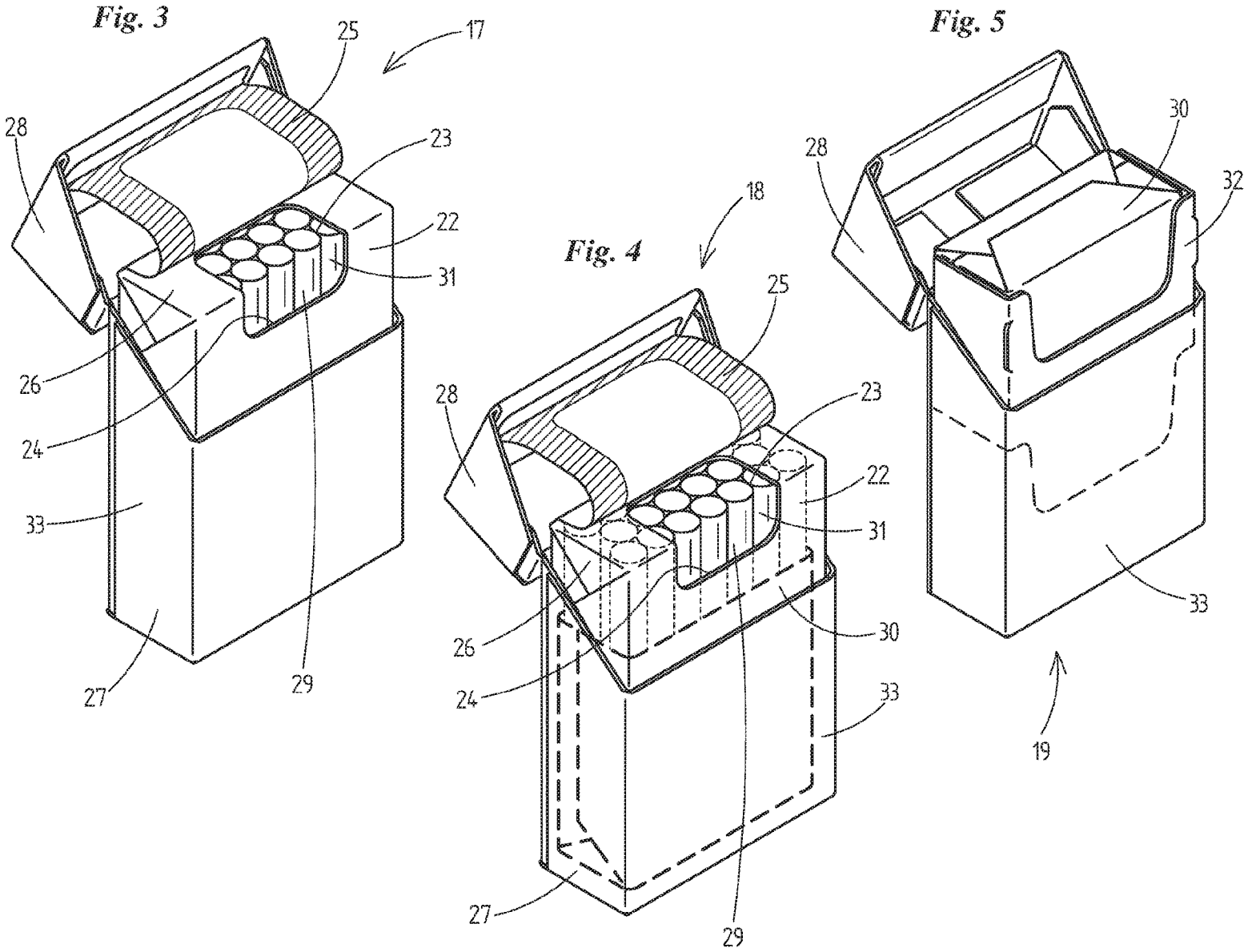
FIG. 3 shows a perspective view of a so-called box-in-box pack, producible in a first configuration of the packaging machine.
FIG. 4 shows the cigarette pack from FIG. 3, but additionally with an innermost wrapping material or tin foil wrapper of the cigarette group, which partially surrounds the cigarette group, producible in a further configuration of the packaging machine.
FIG. 5 shows a standard hinged carton, wherein a wrapping material or tin foil wrapper completely surrounds the cigarette group, producible in a further configuration of the packaging machine according to the invention.
Figure 7:
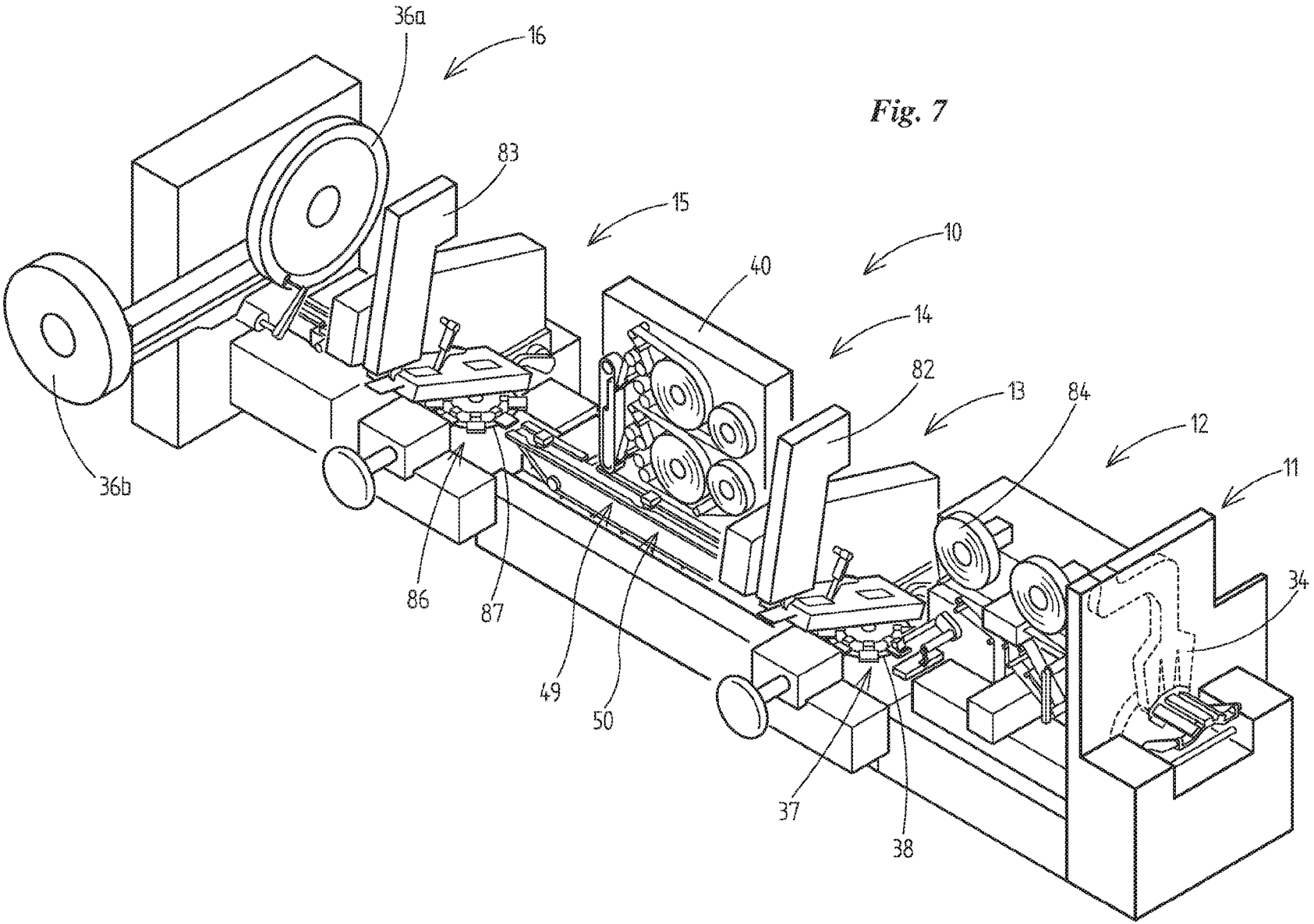
FIG. 7 shows the packaging machine from FIG. 6 in a/the configuration in which it is suitable for producing a box-in-box pack corresponding to FIG. 4.
Figure 8:
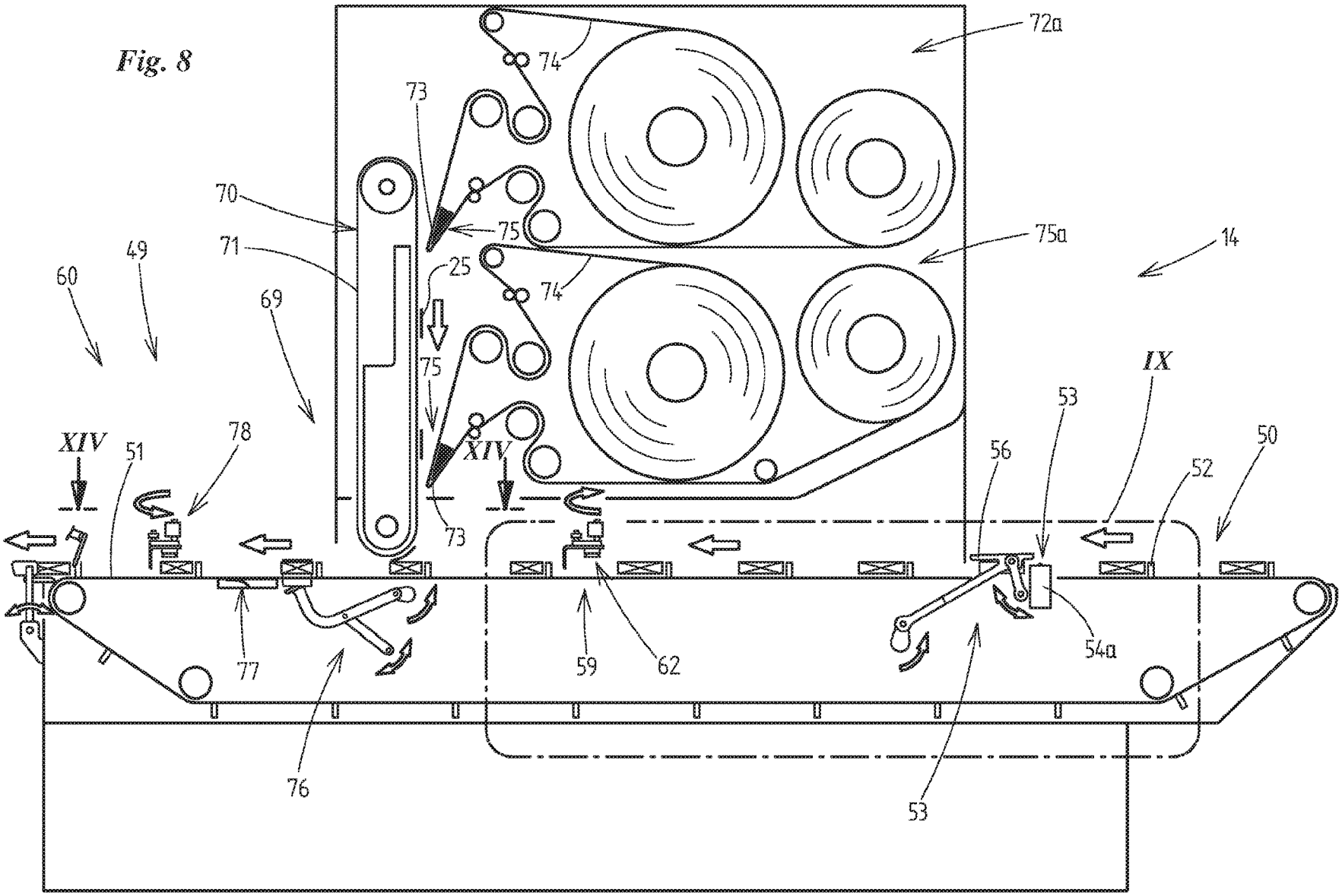
FIG. 8 shows a side view of a separable sealing inner pack unit of the packaging machine corresponding to the configuration from FIG. 7.
Figure 9:
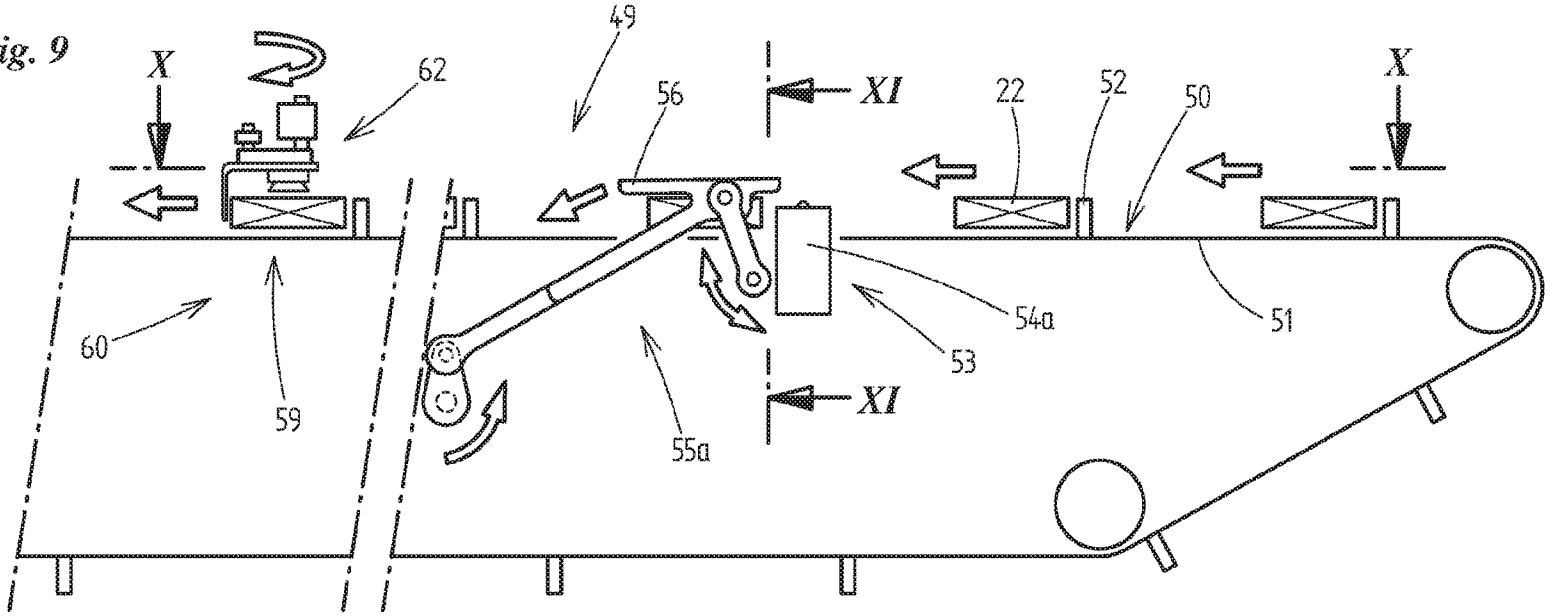
FIG. 9 shows the detail IX from FIG. 8 in an enlarged illustration.
Figure 10:
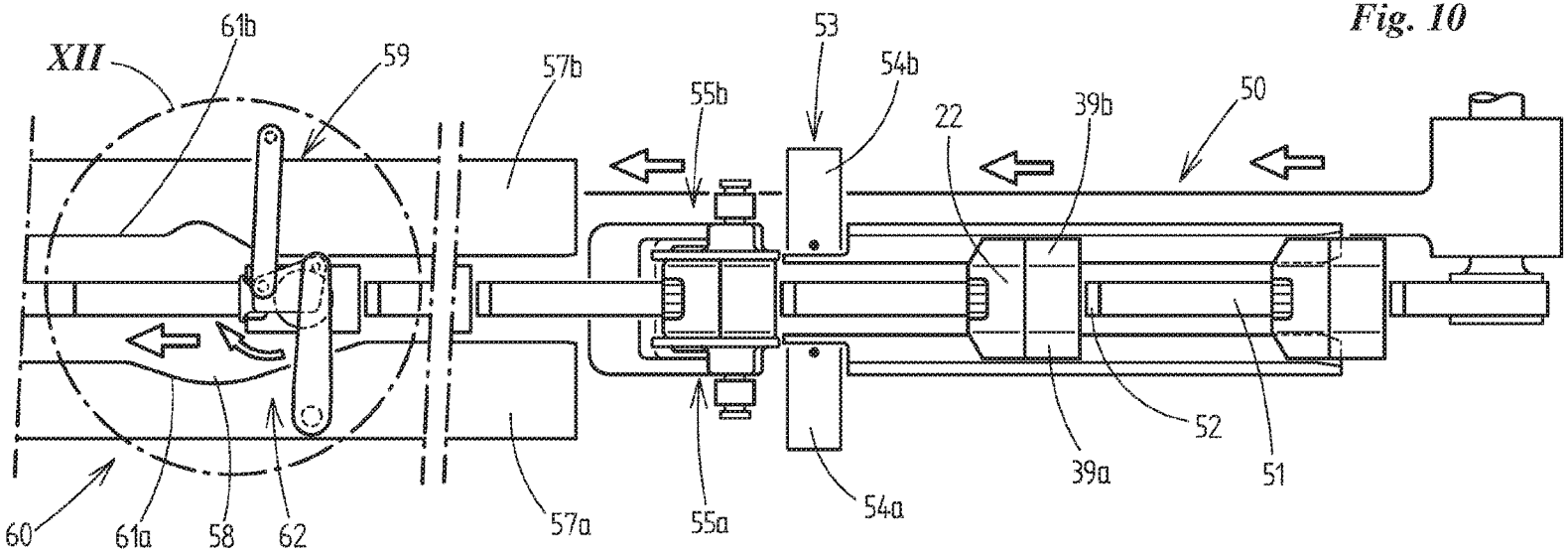
FIG. 10 shows a plan view corresponding to the arrow direction X in FIG. 9.
Figure 11:
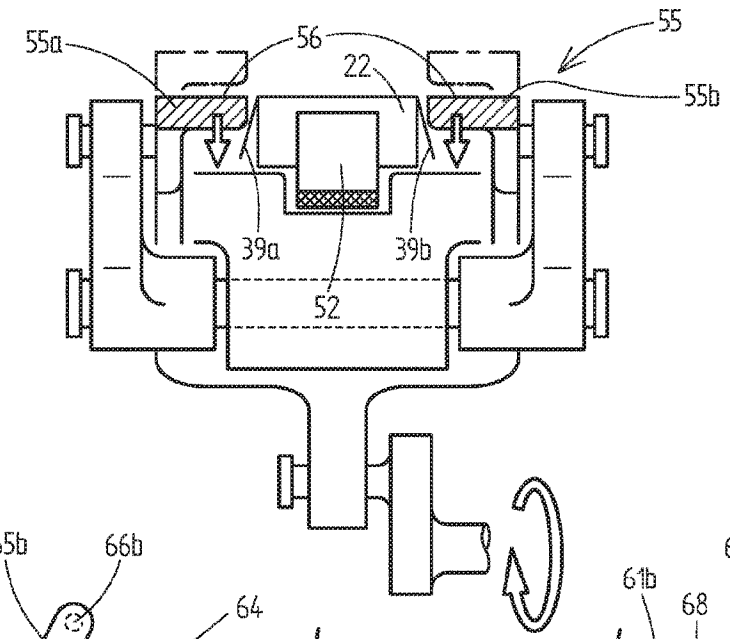
FIG. 11 shows a cross section through the detail of FIG. 9 along the cross-section line XI-XI.

In the configuration as per FIG. 7, it is possible inter alia to produce the pack type 18, "box-in-box with tin foil/wrapping material partial wrapper" illustrated in FIG. 4.

The packaging machine 10 can be easily converted into other configurations in which it is in each case possible to produce inter alia the pack types 17, "box-in-box without tin foil/wrapping material partial wrapper", and 19, "standard hinge lid with complete tin foil/wrapping material wrapper", illustrated in FIGS. 3 and 5.

Furthermore, the packaging machine 10 can be converted into configurations in which so-called sealed bundle packs can be produced. On the one hand, sealed bundle packs 20, cf. FIG. 19, with so-called envelope folding, and sealed bundle packs 21 as flow wrap packs.

The present exemplary embodiments of the configurations of the packaging machine 10 concentrate, without being restrictive, primarily on the production of the aforementioned pack types 17-19.

These are constructed as follows:

In the substantially cuboid box-in-box pack 17, an inner pack 22 composed of dimensionally stable, foldable material, in particular (thin) cardboard or (relatively thick) paper, surrounds a formed cigarette group 23. The inner pack 22 has a removal opening 24 in the upper region for the removal of the cigarettes 29 from the cigarette group 23, which removal opening is closed by a closure label 25 in the closed state of the pack 17.

The closure label 25 is preferably provided with a glue which enables the closure label 25 to be used, or closed and opened, several times.

The closure label 25 forms, together with the inner pack 22, a sealing inner pack 26 which seals off the cigarette group 23 to the outside.

The sealing inner pack 26 is seated in a separate outer pack 27 composed of likewise dimensionally stable material, in particular (thin) cardboard or (relatively thick) paper. In the present case, the outer pack 27 is designed as a so-called hinged-carton or hinge-lid pack. It may alternatively also be designed as a shoulder box or sliding-sleeve pack or some other pack type made of dimensionally stable material.

The closure label 25 is attached in one end region to a pivotable lid part 28 of the outer pack 27, such that, when the lid part 28 is opened relative to a cup-shaped carton part 33 which can be closed by means of the lid part 28 and to which the lid part 28 is pivotably attached, the closure label 25 is automatically moved from a/the closure position, in which it covers the removal opening 24, into a position illustrated in FIG. 3, in which it opens up the removal opening.

This however does not have to be the case. It is also conceivable for the closure label 25 not to be attached to the cover part 28. In this case, the closure label 25 would have a handling section that allows a user to pull the closure label 25 upward by hand in order to open up the removal opening 24.

The pack 18 as per FIG. 4 is substantially identical to the pack 17, such that corresponding parts are denoted by the same reference designations. However, the cigarette group 23 in the pack 18 is additionally partially directly wrapped in a cup-like (or alternatively, for example, U-shaped) wrap 30, specifically with the filters 31 of the cigarettes 29 being at least partially, preferably completely, exposed.

In the present case, the wrap or wrapper 30 is composed of tin foil. It is however also possible for other wrapping materials to be used, such as for example tin foil or (aluminum-laminated) paper.

By means of this wrap 30, it is for example possible for flavourings, such as for example menthol or the like, to be introduced into the cigarettes 29, the wrap 30 being impregnated with these flavourings for this purpose.

The cigarette pack 19 as per FIG. 5 is a conventional hinged-carton or hinge-lid pack. Here, the outer pack 27 corresponds to that of the packs 17, 18. However, the cigarette group 23 (not visible) is not integrated into a dimensionally stable inner pack, but is rather merely surrounded, specifically completely, by a wrap 30.

The material of the wrap 30 of the pack 19 may also be tin foil, aluminum-laminated paper or some other suitable wrapping material. The cigarette pack 19 furthermore has a collar 32 in a known manner.

Figure 6:
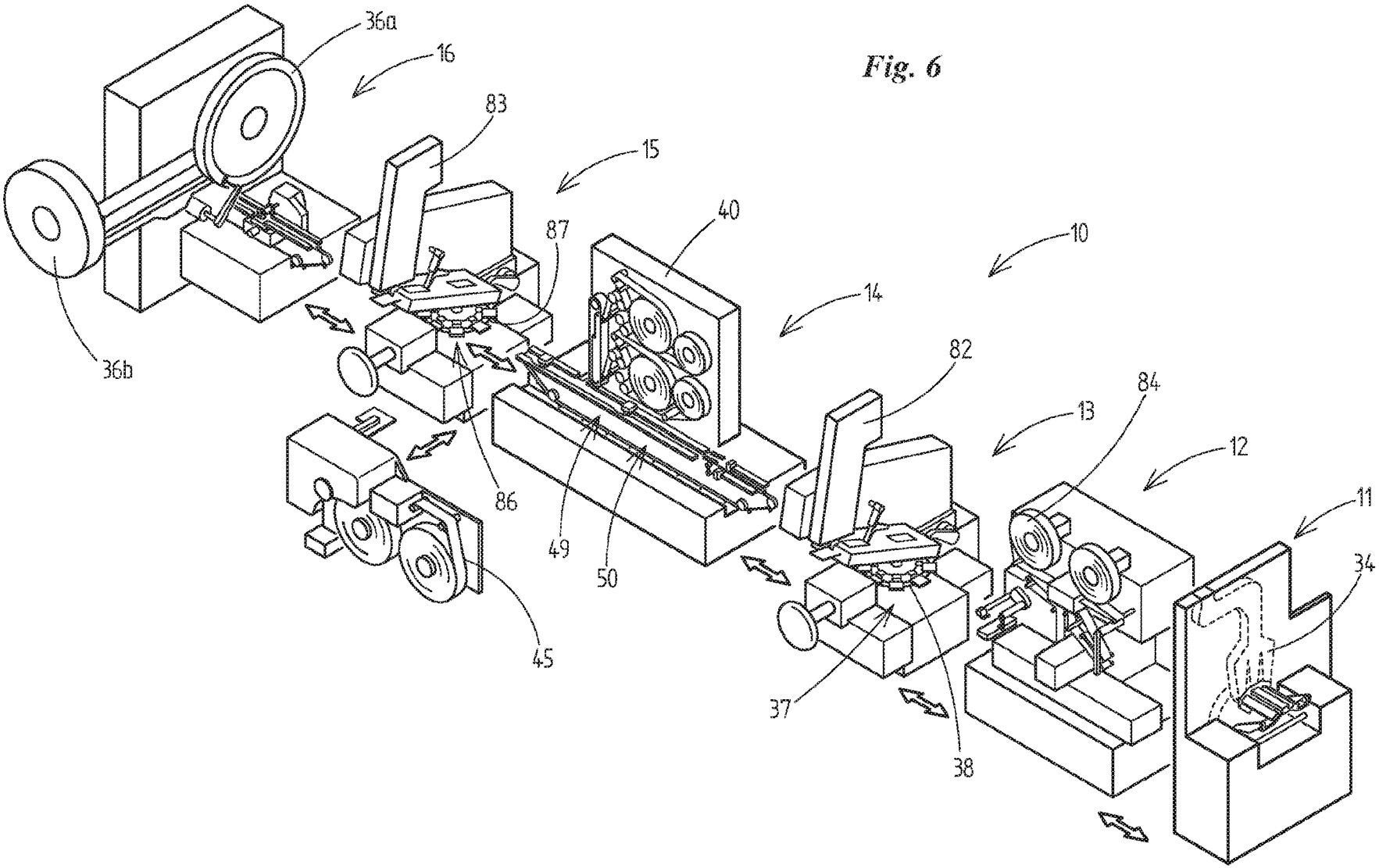
FIG. 6 shows all separable manufacturing units of the packaging machine in a perspective view, in each case spaced apart from one another for the sake of clarity.

The individual separable manufacturing units 11-16 of the packaging machine 10 are non-destructively separable from one another in the region of (imaginary) parting regions or (in particular vertical) parting planes between in each case two adjacent separable manufacturing units 11-16. FIG. 6 shows the manufacturing units 11-16 in a separated state. Respectively adjacent manufacturing units 11-16 have a gap between them, whereas they adjoin one another in each case in FIG. 7.

As indicated above, the packaging machine 10 can assume different configurations or can be converted to a different configuration in each case.

Below, a description will firstly be given of the main functions of the individual separable manufacturing units 11-16 of the packaging machine 10.

With the machine configuration as per FIG. 7, box-in-box packs 18 with a partial wrap 30 can be manufactured.

In the separable manufacturing unit 11—forming unit—individual cigarettes 29 originating from a cigarette magazine 34 are formed into cigarette groups 23 (in general, a cigarette group is composed of three layers of cigarettes arranged one above the other, though there may also be more or fewer layers) and subsequently transferred to the separable manufacturing unit 12.

The separable manufacturing unit 12 is a transfer or wrapping unit, the function of which is to transfer the cigarette groups 23 to the subsequent adjacent separable manufacturing unit, specifically a first separable folding unit 13.

Figure 19:
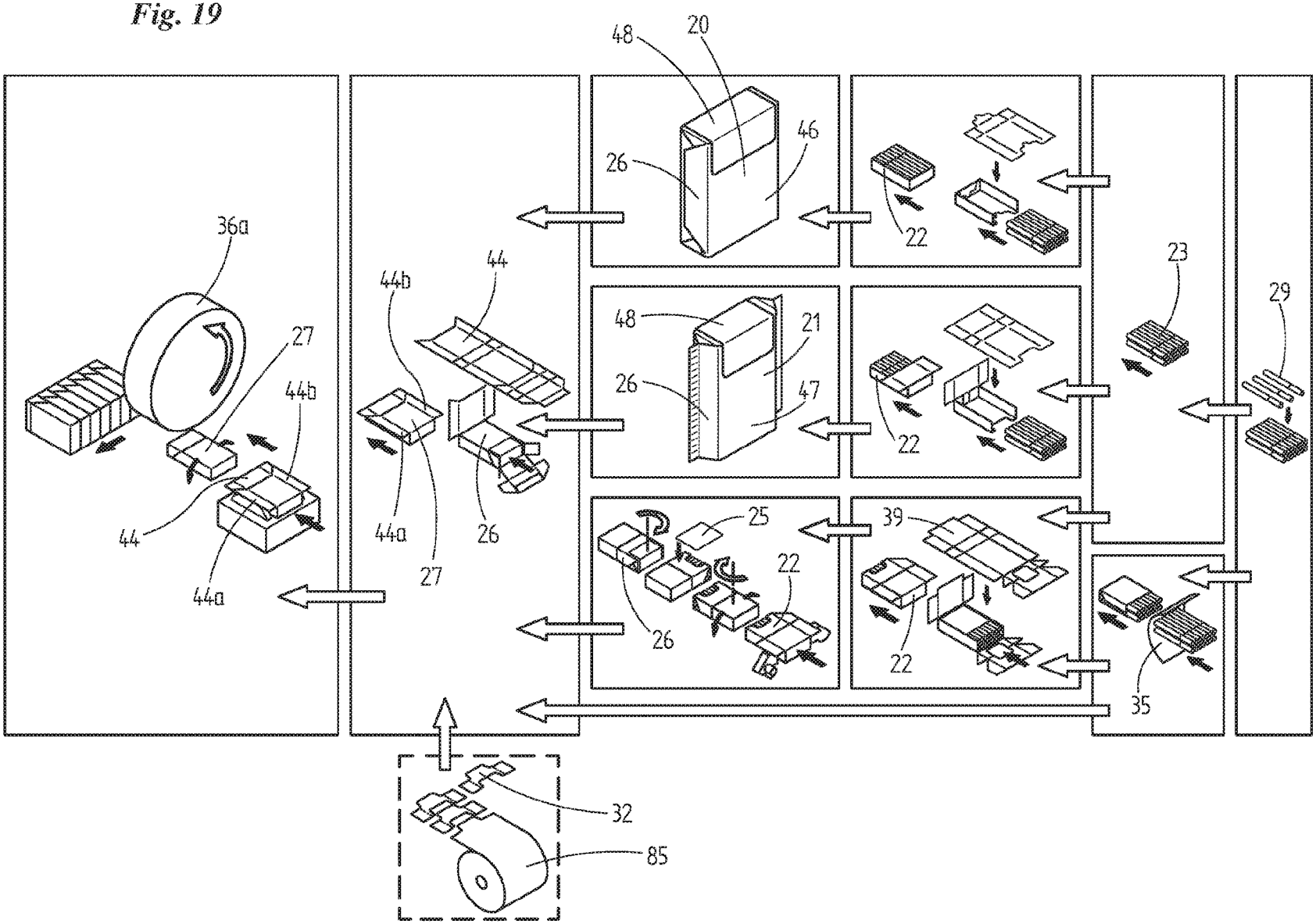
FIG. 19 shows an overview of various main handling steps in further alternative configurations of the packaging machine in which, instead of box-in-box packs, so-called sealed bundle packs with envelope folding or flow-wrap packs can be manufactured.

The separable transfer or wrapping unit 12 furthermore provides the cigarette groups 23 in each case with a or the wrap 30. For this purpose, blanks 35 are in this case cut from a bobbin 84, and in each case one blank 35 for such a wrap 30, cf. also FIG. 19, is folded around the cigarette group 23.

If such a wrap 30 is not desired, for example because the box-in-box packs 17 are to be manufactured without a wrap, the separable transfer or wrapping unit 12 can be replaced with another transfer or wrapping unit, in the case of which the corresponding apparatuses for providing the cigarette group 23 with the wrapper 30 are omitted.

Alternatively, it would also be possible for this purpose for the separable transfer or wrapping unit 12 to be removed from the packaging machine 10 without substitution, and for the separable manufacturing units 11, 13 to be brought directly together in the parting regions or parting planes. The cigarette groups 23 would then be conveyed directly from the forming unit 11 to the first folding unit 13.

It is once again alternatively also conceivable for the separable transfer or wrapping unit 12 to be designed such that, as required, either the cigarette groups 23 are provided with the wrapper 30 or the cigarette groups 23 are conveyed onward without further measures to the first folding unit 13. The cigarette group 23 may then be conveyed either with or without a wrap 30 to the first folding unit 13.

In the separable first folding unit 13, in the configuration of FIG. 7, the inner pack 22 is formed by virtue of in each case one inner blank 39, which originates from a blank magazine 82 and which is suitable for forming the inner pack 22 (composed of cardboard or the other dimensionally stable material), being folded around the respective cigarette group 23.

For this purpose, the separable first folding unit 13 has a folding device 37 which comprises inter alia a folding revolver 38, in the present case rotating in a horizontal plane.

In the first separable folding unit 13, cf. also FIG. 1, the cigarette group 23 (possibly together with the wrap 30) is integrated into an inner blank 39 which is held ready, said inner blank being folded around the cigarette group 23 by means of suitable folding members in order to form the inner pack 22.

In the present exemplary embodiment, the inner pack 22 formed is folded substantially into a final state, aside from two side tabs 39*a*, 39*b* which protrude (in a horizontal plane), in the first separable folding unit 13.

The side tabs 39*a*, 39*b* are folded into a final state and glued only in the next, adjoining separable manufacturing unit 14 in the manufacturing flow direction.

This separable manufacturing unit 14 to which the inner packs 22 are conveyed after their partial completion is a separable sealing inner pack unit, in which a or the sealing inner pack 26 is formed or manufactured in each case from the inner pack 22.

For this purpose, in particular, cf. also FIG. 1, the closure label 25 is in each case applied by means of a labeling appliance 40 to the removal opening 24 of the respective inner pack 22.

Furthermore, the separable sealing inner pack unit 14 comprises a turning device 60 which rotates the respective inner pack 22 or the sealing inner pack 26 manufactured from the inner pack 22 in two steps through in each case 90°, and thus through a total of 180°, relative to a conveying path 50 of a conveying device 49 of the separable sealing inner pack unit, along which the inner packs 22 are each conveyed.

Before this, the side tabs 39*a*, 39*b* of the inner pack 22 which have not yet been folded into the final state in the separable sealing inner pack unit 14 are provided with glue and folded into a final state.

The further details in this regard will be discussed more specifically further below.

The sealing inner packs 26 manufactured from the inner packs 22 by the separable sealing inner pack unit 14 are then transferred to a separable second folding unit 15.

In the separable second folding unit 15, an outer blank 44 composed of cardboard (or another suitable dimensionally stable material, cf. above) and originating from a blank magazine 83 is folded around the sealing inner pack 26, in each case so as to form the outer packs 27, cf. also FIG. 1. For this purpose, the separable second folding unit 15 has a folding device 86 which comprises inter alia a folding revolver 87, in the present case rotating in a horizontal plane. In the second separable folding unit 15, the sealing inner pack 26 is accordingly integrated into an outer blank 44 which is held ready, said outer blank being folded around the cigarette group 23 by means of suitable folding members in order to form the outer pack 27.

Here, the outer pack 27 is, similarly to the inner pack 22, folded substantially into a final state, aside from two side tabs 44*a*, 44*b* which protrude laterally (in a horizontal plane), in the separable second folding unit 15.

In this state, having been folded substantially into a final state, with protruding side tabs 44*a*, 44*b*, the outer packs 27 are conveyed onward to the separable manufacturing unit 16, specifically a separable curing unit.

One of the main functions of the separable curing unit 16 is to allow the curing of adhesive between folding tabs of the inner pack 22 and/or outer pack 27, and possibly of the wrap 30, which have been adhesively bonded together. For this purpose, the conveying device may for example have two curing wheels, in particular drying wheels or revolvers 36*a*, 36*b*.

Additionally, in the present case, the side tabs 44*a*, 44*b* have glue applied to them, and are folded into a final state, in the separable curing unit 16, cf. also FIG. 1.

As already indicated above, the packaging machine 10 can, for example, be converted from the configuration shown in FIG. 7 to another configuration, in which a different pack type can be produced.

For example, in a configuration in which the box-in-box pack 17 can be produced by virtue of the transfer or wrapping unit 12, which also manufactures the wrap 30, being replaced with the simple transfer unit (not illustrated) which does not manufacture such a wrap 30 and which transfers or conveys the cigarette groups 23 without the wrapper from the forming unit 12 to the separable first folding unit 13.

Proceeding from the configuration of FIG. 7, the packaging machine 10 can also be converted into a configuration in which the cigarette packs 19, that is to say the conventional hinge-lid packs or similar packs, are manufactured. For this purpose, the first separable folding unit 13 can be removed from the manufacturing line. The same applies to the sealing inner pack unit 14. The transfer or wrapping unit 12, in which a blank composed of wrapping material, in particular foil material or (coated) paper, such as tin foil or aluminum-laminated paper, is then folded around the cigarette group 23 to form a wrap 30 which completely or partially surrounds the cigarette group 23, and the forming unit 11 are then brought into a position directly adjacent to the second separable folding unit, so that the gaps left by the first separable folding unit 13 and the sealing inner pack unit 14 are filled.

In this case, a further separable manufacturing unit 45 shown in FIG. 6 is additionally added to the manufacturing line, specifically a separable collar unit 45.

This separable collar unit 45 is then integrated into the manufacturing flow of the packaging machine 10 in the region of the separable second folding unit 15. In the collar unit 45, individual collars 32 (composed of cardboard or some other dimensionally stable material) are cut from a collar material web 85, cf. also FIG. 1, and placed onto the respective block composed of cigarette group 23 and wrap 30.

Proceeding from the configuration of FIG. 7, the packaging machine 10 can also be converted into a configuration in which the sealed bundle packs 20, 21 are manufactured, cf. FIG. 19.

In this case, the separable sealing inner pack unit 14 from FIG. 7 would have to be removed and replaced by another separable sealing inner pack unit (not shown), which produces a corresponding foil wrapper 46 or 47, cf. FIG. 19, into which the respective inner packs 22 are integrated, specifically in each case with a closure label 48 attached to a removal opening of the foil wrapper 46, 47. The functional groups that another separable sealing inner pack unit of said type would have to have for this purpose are known.

The separable sealing inner pack unit 14, by means of which the seal inner packs 26 are manufactured or formed from the inner packs 22 correspondingly to the configuration from FIG. 7 for manufacturing the box-in-box packs 17 or 18, is formed in a special manner:

The conveying device 49 of the separable sealing inner pack unit 14 has an (endless) conveying belt 51 (toothed belt) with individual, spaced-apart drivers 52.

The drivers 52 delimit receptacles for the inner packs 22. The rectilinear conveying path 50 of the conveying device 49, along which the inner packs 22 or, subsequently, the sealing inner packs 26 formed therefrom are conveyed, extends along the entire sealing inner pack unit 14, specifically between the two parting planes, which are adjoined in each case on one side by the first folding unit 13 and on the other side by the second folding unit 15.

A glue-applying unit 53 for applying glue to the side tabs 39*a*, 39*b* is arranged in a first region of the conveying path 50 in a manufacturing flow direction. The inner packs 22 are fed to the glue-applying unit 53 with cigarettes 29 oriented parallel to the conveying direction, specifically in the present case with filters 31 situated at the front in the conveying direction. In this orientation, they have been conveyed out of the folding revolver 38 of the first separable folding unit 13 and transferred onto the conveying path 50.

The glue-applying unit 53 has in each case a glue valve 54*a*, 54*b* to/at each side of the conveying path 50. By means of the glue-applying unit 53, glue, in particular hot melt, is applied to the inner packs 22 conveyed along the glue-applying unit 53, specifically (from below) to the laterally protruding side tabs 39*a*, 39*b*.

A side tab folding unit 55 is arranged immediately downstream of the glue-applying unit 53 (downstream in the manufacturing flow). With the side tab folding unit 55, the side tabs 39*a*, 39*b* are folded (downward) and brought into their final position, specifically are folded onto, or laid against, further side tabs of the inner pack 22 which are already situated in a final position.

For this purpose, the side tab folding unit 55 has in each case one motor-driven, movable side tab folding member 55*a* or 55*b* at/to both sides of the conveying path 50.

The side tab folding members 55*a*, 55*b* move in (vertical) planes which are perpendicular to the (horizontal) conveying plane of the inner packs 22 and perform reciprocating movements there. In particular, in such a way that in each case one folding part 56 of the respective side tab folding member 55*a*, 55*b* is, during the folding process, guided from above against the side tabs 39*a*, 39*b* and pivoted downward while in contact with said side tabs, so as to drive said side tabs along. There are self-evidently also other possibilities for folding the folding tabs 39*a*, 39*b*.

The conveying device 49 has, along the conveying path 50, lateral guides 57*a*, 57*b* with different sections. Each lateral guide 57*a*, 57*b* has an associated (in particular vertical) guide surface 61*a*, 61*b*. The guide surfaces 61*a*, 61*b* are situated opposite one another with a spacing.

In order to hold the side tabs 39*a*, 39*b* folded by means of the side tab folding unit 55 in position while the respective inner packs 22 are conveyed onward, the lateral guides 57*a*, 57*b* or the guide surfaces 61*a*, 61*b* downstream of the side tab folding unit 55 are initially arranged parallel to one another, specifically with a spacing to one another which approximately corresponds to the pack width of the inner pack 22, that is to say to the spacing between the narrow longitudinal sides (formed by the side tabs 39*a*, 39*b* and the further side tabs) of the inner pack 22, as far as a first turning location 58.

The inner packs 22 are guided along this section of the lateral guides 57*a*, 57*b* as far as the turning location 58, which is part of a first turning station 59 of a turning device 60.

In the first turning station 59, the inner packs 22 are turned or rotated in each case through 90°, such that the cigarettes 29 previously oriented parallel to the conveying direction in the inner packs 22 are subsequently oriented transversely with respect to the conveying direction.

In order to create space for this turning process, the lateral guides 57*a*, 57*b* widen in the area of the turning location 58, or the spacing between the guide surfaces 61*a*, 61*b* is increased in the region of the turning location 58 in relation to the section immediately upstream of the lateral guides 57*a*, 57*b*.

For this purpose, the guide surfaces 61*a*, 61*b* of the lateral guides 57*a*, 57*b* each run outward (away from one another) in a curved manner in the region of the turning location 58.

Following the turning location 58 (downstream thereof), the lateral guides 57*a*, 57*b* or guide surfaces 61*a*, 61*b* thereof again run parallel in a further section, but with a spacing which is slightly greater than that in the section upstream of the turning location 58 and which approximately corresponds to the length of the inner pack 22 (spacing between the base bottom side and lid top side).

The turning device 60 or the first turning station 59 has, in the region of the turning location 58, a turning appliance 62 by means of which the respective inner pack 22 is turned/rotated through 90° relative to the conveying path 50. For this purpose, the turning unit 62 has a holding member 63, the holding forces of which can be controlled, in particular activated and deactivated. In the present case, a controllable suction member which can be charged with negative pressure.

The holding member 63, the holding forces of which can be activated and deactivated, can be moved by means of a motor.

For this purpose, the holding member 63 is in the present case connected to a pivot lever mechanism 64 with a first pivot lever 65*a* and a second pivot lever 65*b*. The two pivot levers 65*a*, 65*b* are each rotatable at one end about axes of rotation 66*a*, 66*b* running perpendicular to the conveying plane of the inner packs 22.

The other ends of the pivot levers 65*a*, 65*b* are rotatably articulated on a support part (support plate) 67 which is arranged, in the region of the turning location 58, above the conveying belt 51. The holding member 63 is fastened to this support part 67.

Figure 12:
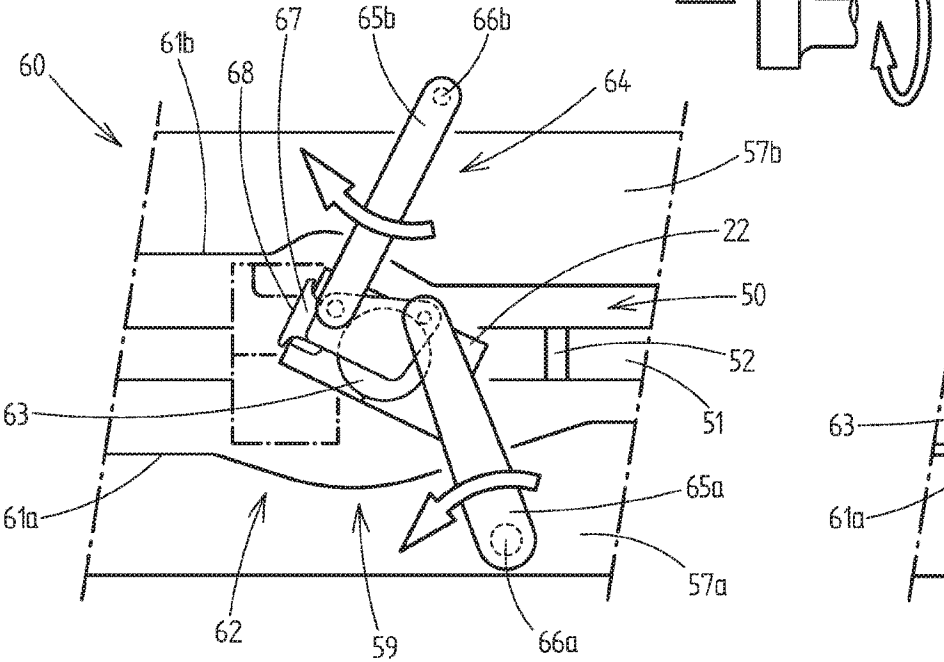
FIG. 12 shows the detail XII from FIG. 10 in an enlarged illustration.
Figure 13:
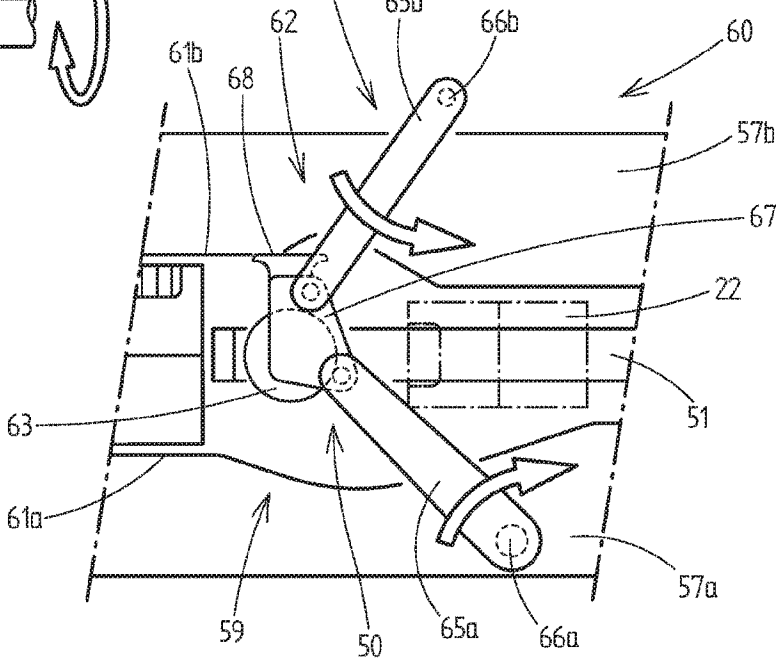
FIG. 13 shows the detail from FIG. 12 in a subsequent movement state.

By means of motor-driven pivoting of the pivot levers 65*a*, 65*b*, cf. FIGS. 12 and 13, about the pivot axes 66*a*, 66*b*, the support part 67 can be moved together with the holding member 63.

The pivot lever mechanism 64 is designed such that the holding member 63 can perform both rotational movements about axes of rotation running perpendicular to the conveying plane of the inner packs 22 and translational movements in a plane parallel to the conveying plane of the inner packs 22 (horizontal plane). In particular, translational movements with a movement component in the conveying direction or opposite thereto.

Here, in the process, each inner pack 22 conveyed into the region of the turning location 58 is firstly conveyed under the holding member 63 until it abuts (by way of the pack top side) against a front stop 68 arranged on the support part 67.

At this moment at the latest, the holding force of the holding member 63 is activated (in the present case, the holding member is charged with negative pressure), such that the holding member 63 grips the inner pack 22 by suction.

In this state in which it is gripped by suction or held, the holding member 63 is then initially accelerated to a certain degree in the conveying direction in order to withdraw it from the engagement of the conveying device 49 or from the contact with the corresponding driver 52. Subsequently or in an overlapping manner, a rotational movement of the holding member 63 occurs, cf. FIG. 12, until the inner pack 22 is oriented transversely or perpendicularly with respect to the conveying direction or conveying path 50. During this rotational movement, the stop 68 guides the inner pack 22.

When the pack is in the 90° position, in which the stop 68 guides the pack laterally or lies laterally against the latter, the holding forces of the holding member 63 are deactivated, such that the inner pack 22 is released from the holding member 63 again. The inner pack 22 is then conveyed onward in the transverse orientation in relation to the conveying path 50.

Downstream of the first turning location 58, there is arranged a labeling station 69 at which the closure labels 25 are applied to the inner pack 22, such that the respective closure label 25 covers the respective removal opening 24, so as to form the sealing inner packs 26.

The labeling appliance 40 is arranged in the region of the labeling station 69. Said labelling appliance has a label conveyor 70 which is arranged perpendicular to the conveying plane (vertically) and which conveys individual closure labels 25 into an application region in which the inner packs 22 conveyed past under the label conveyor 70 are each equipped with the respective label 25.

In the present case, the label conveyor 70 is designed as a suction conveyor, such that the labels 25 are held on the conveying belt 71 of the label conveyor 70 by means of negative pressure during the transport to the application region.

The labels 25 originate in each case from labeling units 72*a* or 72*b*. Each labeling unit 72*a*, 72*b* has in each case one peel-off station 75 with in each case one peel-off member 73, for example a peel-off edge, by means of which individual labels 25 are peeled off from a label carrier strip 74 and are applied to the conveying belt 71.

The labels 25 applied in each case to the inner packs 22 in the application region must also be folded into a final position.

Figure 14:
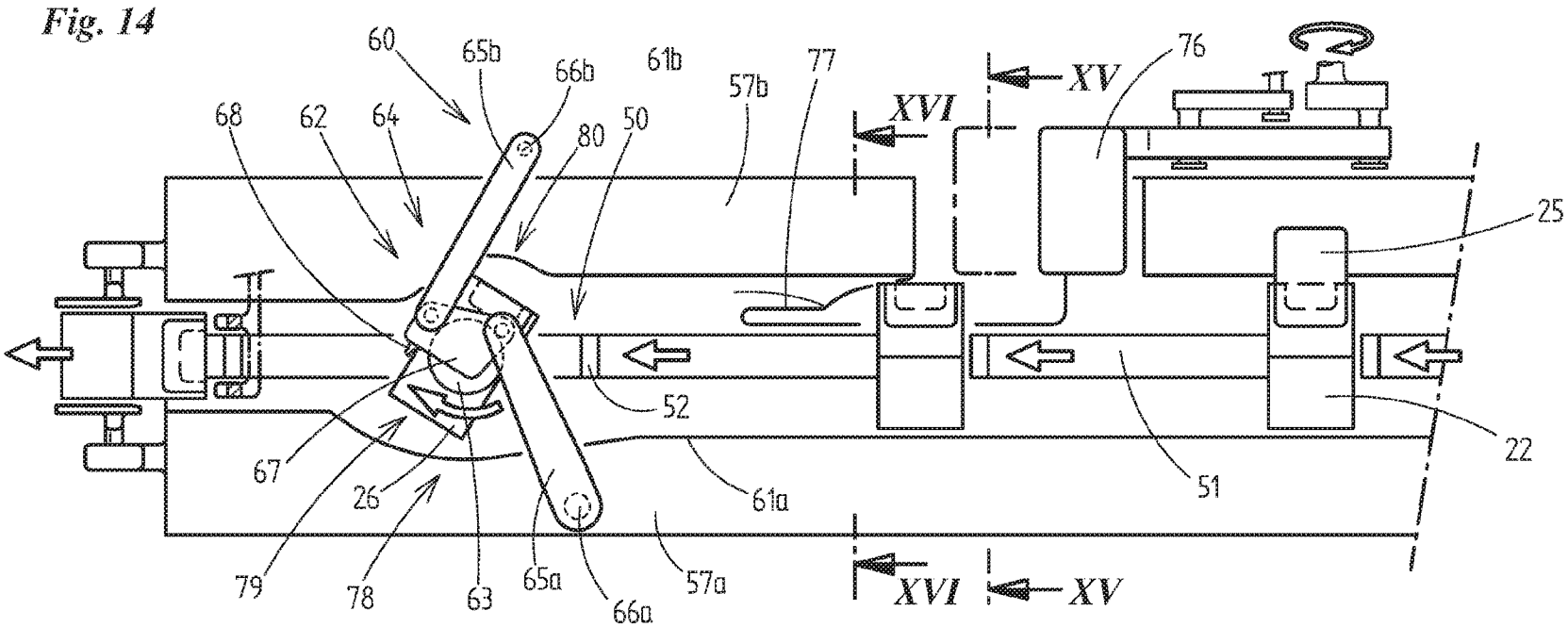
FIG. 14 shows a plan view of the section of the separable sealing inner pack unit from FIG. 8 corresponding to the viewing direction XIV in FIG. 8.
Figure 15:
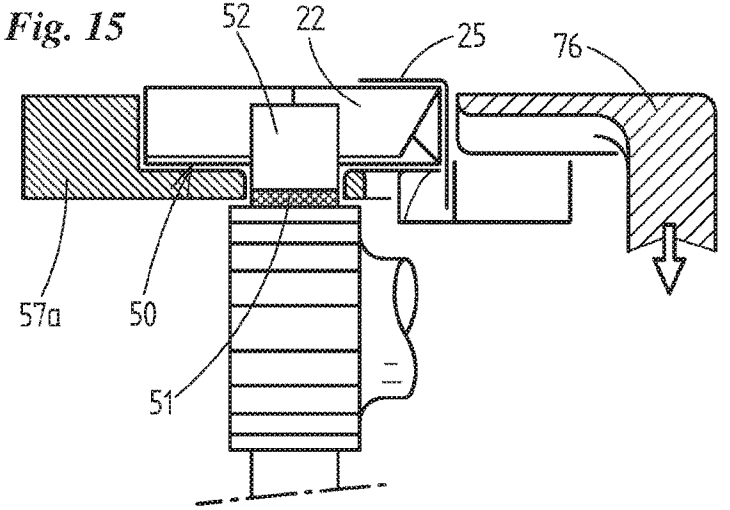
FIG. 15 shows a cross-sectional view along the cross-section line XV-XV in FIG. 14.

For this purpose, firstly, on one side of the conveying path 50, there is arranged a lateral, motor-driven label folding member 76, cf. FIG. 15, which folds an initially laterally protruding section, cf. FIG. 14, of the applied label 25 onto the face side or top side, arranged transversely with respect to the conveying plane, of the inner pack 22.

Figure 16:
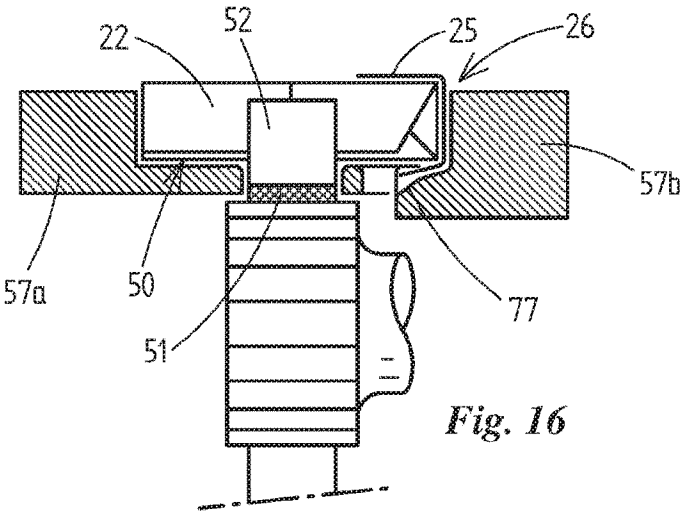
FIG. 16 shows a cross-sectional view along the cross-section line XVI-XVI in FIG. 14.

A stationary label folding member 77 is arranged downstream of the label folding member 76. Said stationary label folding member is designed as a folding switch and is part of the lateral guide 57*b*, cf. FIG. 16. With the aid of the folding switch, an end section of the label 25 is folded over and applied to the rear or rear wall, running transversely with respect to the face side, of the inner pack 22.

Alternatively, an actively moving folding member could of course also be used for this.

Figure 17:
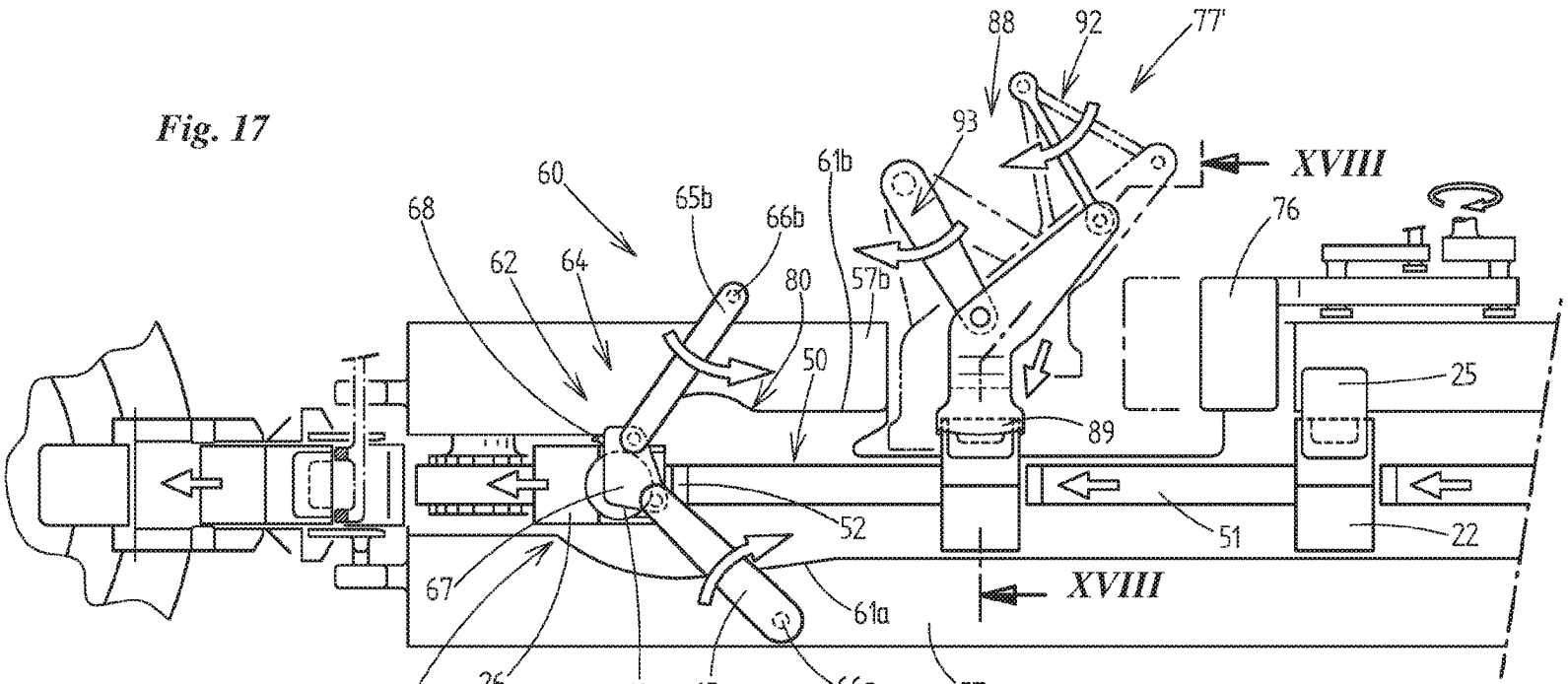
FIG. 17 shows a plan view corresponding to FIG. 14, but in an alternative embodiment with a further active label folding member.
Figure 18:
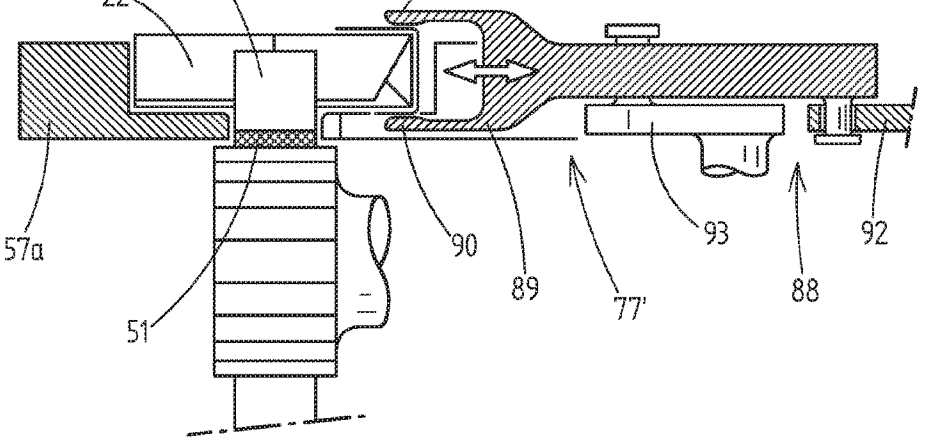
FIG. 18 shows a cross-sectional view along the cross-section line XVIII in FIG. 17.

Such an alternative is shown in FIGS. 17 and 18. In comparison to FIG. 14, the stationary label folding member 77 there is replaced by such an actively (reciprocatingly) moved label folding member 77'. The label folding member 77', specifically a front folding part 89 thereof, as it is moved closer to the inner pack 22, folds the end section of the label 25 over onto the rear side of the inner pack 22.

Here, the active label folding member 77' is driven by means of a transmission 88, in the present case in the form of a crank drive with lever 92 and crank 93.

The transmission 88 is designed such that the front folding part 89 of the label folding member 77' is, during the transport of the inner pack 22, moved closer to the latter from the side and subsequently driven along by a certain distance in a conveying direction of the inner pack 22.

In the present case, the folding part 89 is designed as a U-shaped fork with two folding fingers 90, 91 arranged parallel to and spaced apart from one another, the spacing between them being adapted to the thickness or depth of the inner pack 22 (so as to be somewhat larger than the thickness/depth) in such a way that the inner pack 22 can protrude into the space between the two folding fingers 90, 91 during the course of the folding part 89 being moved closer to the inner pack 22.

For this purpose, the lower folding finger 90 extends slightly below the plane of the rear wall of the inner pack 22 and parallel thereto, and the upper folding finger 91 extends slightly above the front wall of the inner pack 22 and parallel thereto.

As the folding part 89 is moved closer, the lower folding finger 90 is moved against that end section of the label 25 which initially extends downward or parallel to the face side of the inner pack 22, and, during a continued movement, said lower folding finger folds said end section over onto, or applies said end section to, the rear side of the inner pack 22.

Downstream of the labeling station 69, in particular downstream of the label folding switch 77, a second turning station 78 of the turning device 60 is arranged in the region of a further turning location 80. In order to create space for the turning/rotating of the respective sealing inner pack 26, the guide surfaces 61*a*, 61*b* also have, in the region of the further turning location 80, a section in which they are spaced further apart than in the section immediately upstream of the turning location 80.

The second turning station 78 has, in the region of the second turning location 80, a turning appliance 79 with the same members and components as the turning appliance 62. Correspondingly, the same reference designations are used, cf. FIG. 14.

By means of the turning appliance 79, the respective inner pack 22 or the respective sealing pack 26 is rotated once more through 90° relative to the conveying path 50, such that the two rotations in the two turning stations 59, 78 in each case through 90° result in a total rotation of the cigarette group 23 situated in the respective inner pack 22, or, downstream of the labeling station 69, in the sealing inner pack 26, by 180° relative to the conveying path 50.

Following or downstream of the turning location 80, the lateral guides 57*a*, 57*b* or their guide surfaces 61*a*, 61*b*, in a further section, run parallel again but with a somewhat smaller spacing than in the section upstream of the turning location 58, which approximately corresponds again to the width of the inner pack 22.

Overall, with the turning device 60, as already indicated above, the orientation of the cigarettes of the cigarette groups 23, which are fed to the separable sealing inner pack unit 14 within the inner packs 22 with cigarettes 29 oriented parallel to the conveying direction and filters 31 situated at the front in the conveying direction, is rotated in its orientation through 180°, such that said cigarette groups leave the separable sealing inner pack unit 14 again with cigarettes 29 likewise oriented parallel to the conveying direction but with filters 31 situated at the rear in the conveying direction.

It is also pointed out that, although the folding members 76, 77, 77' are, in the drawings or the illustrated embodiments, arranged on the side situated opposite the operator side of the packaging machine 10 with respect to the conveying flow direction of the inner packs 22, this does not have to be the case. Said folding members may self-evidently also be arranged on the operator side of the packaging machine 10, in which case the directions of rotation of the first turning station 59 would have to be adapted such that the label sections to be folded correspondingly point toward the operator side. The direction of rotation of the second turning station 78 would then also be adapted correspondingly.

We expressly reserve the right to make each of the features mentioned above or in this application, where technically meaningful, individually or in any combination with others of the features above or mentioned in this application, the subject of a claim for protection.

LIST OF REFERENCE DESIGNATIONS

10 Packaging machine
11 Manufacturing unit
12 Manufacturing unit
13 Manufacturing unit
14 Manufacturing unit
15 Manufacturing unit
16 Manufacturing unit
17 Box-in-box
18 Box-in-box with tin foil partial wrapper
19 Box-in-box with complete tin foil wrapper
20 Sealed bundle packs
21 Sealed bundle packs
22 Inner pack
23 Cigarette group
24 Removal opening
25 Closure label
26 Sealing inner pack
27 Outer pack
28 Lid part
29 Cigarettes
30 Wrap
31 Filter
32 Collar
33 Carton part
34 Cigarette magazine
35 Blank
36*a* Curing revolver
36*b* Curing revolver
37 Folding device
38 Folding revolver
39 Inner blank
39*a* Side tabs
39*b* Side tabs
40 Labeling appliance
44 Outer blank
44*a* Side tabs
44*b* Side tabs
45 Collar unit
46 Foil wrapper, sealed bundle
47 Foil wrapper, sealed bundle
48 Closure label
49 Conveying device
50 Conveying path
51 Endless conveying belt
52 Driver
53 Glue-applying unit
54*a* Glue valve
54*b* Glue valve
55 Side tab folding unit
55*a* Side tab folding member
55*b* Side tab folding member
56 Folding parts
57*a* Lateral guide
57*b* Lateral guide
58 Turning location
59 Turning station
60 Turning device
61*a* Guide surface
61*b* Guide surface
62 Turning appliance
63 Holding member
64 Pivot lever mechanism
65*a* Pivot lever
65*b* Pivot lever
66*a* Axis of rotation
66*b* Axis of rotation
67 Support part
68 Stop
69 Labeling station
70 Label conveyor
71 Conveying belt
72*a* Labeling unit
72*b* Labeling unit
73 Peel-off member
74 Label carrier strip
75 Peel-off station
76 Label folding member
77 Label folding member
77' Label folding member
78 Turning station
79 Turning appliance
80 Turning location
82 Blank magazine, inner blank
83 Blank magazine, outer blank
84 Tin foil bobbins
85 Collar material web
86 Folding device
87 Folding revolver
88 Transmission
89 Folding part
90 Lower folding finger
91 Upper folding finger
92 Lever
93 Crank

The invention claimed is:

1. A packaging machine for producing packs with a group (23) of cigarettes (29) as pack content, wherein the packaging machine (10) has at least the following in succession in a manufacturing flow direction:

a forming unit (11) for forming respective cigarette groups (23) comprising cigarettes (29) originating from a cigarette magazine;

a first folding unit (13) at which an inner blank composed of cardboard or of some other material suitable for forming a dimensionally stable inner pack is folded at least in certain regions around the respective cigarette group (23) so as to form an inner pack (22) with the respective cigarette group (23) as pack contents;

a sealing inner pack unit (14) adjoining said first folding unit (130, in which sealing inner pack (14) a sealing inner pack (26) is manufactured in each case from the inner pack (22) or in which the sealing inner pack (26) is folded into a final state or in which in each case one sealing inner pack (26) comprising the inner pack (22) is manufactured;

a second folding unit (15) at which an outer blank composed of cardboard or of some other material suitable for forming a dimensionally stable outer pack is in each case folded around the sealing inner pack (26) in each case so as to form an outer pack (27);

a conveying device located between the first and second folding units (13, 15), the conveying device having a rectilinear conveying path for conveying the respective cigarette group (23); and a turning device (60) arranged between the first and second folding units (13, 15), wherein the conveying device conveys the respective cigarette group (23), which is integrated into the inner pack (22) or the sealing inner pack (26), namely with cigarettes (29) oriented parallel to the conveying direction, into the region of the turning device (60), the turning device (60) rotating the respective cigarette group (23) within or parallel to a conveying plane of the conveying device, and the turning device (60) being designed so as to rotate the respective cigarette group (23) about at least one axis of rotation which is arranged perpendicular to a cigarette longitudinal extent of cigarettes (29) in the respective cigarette group (23).

2. The packaging machine as claimed in claim 1, wherein the conveying device which conveys the respective cigarette group (23) to the turning device (60) conveys the cigarette group (23) downstream of the turning device (60) to the second folding unit (15).

3. The packaging machine as claimed in claim 2, wherein the turning device (60) has a first turning station (59), which rotates the respective cigarette group (23) through a certain angle of rotation of 90° , and, downstream of the first turning station (59), a second turning station (78), which rotates the cigarette group (23), either in the same direction of rotation or in the opposite direction of rotation in relation to the first turning station (59), also through a 90° angle of rotation.

4. The packaging machine as claimed in claim 3, wherein the turning device (60) has, in the region of the conveying path of the conveying device, a motor-driven, rotatable holding member, the holding forces of which holding member can be activated and deactivated, by means of which the respective pack into which the cigarette group (23) is integrated as pack content comprising the inner pack (22) or the sealing inner pack (26) can, in the held state, be withdrawn from the conveying engagement of the conveyor and, by rotation of the holding member, rotated relative to the conveying path.

5. The packaging machine as claimed in claim 4, wherein the conveying device has, to/at both sides of the conveying path, lateral guides with in each case one guide surface for the respectively conveyed cigarette group (23) integrated into the inner pack (22) or the sealing inner pack (26), wherein the guide surfaces, at least in one section, run parallel with a spacing to one another and, in another section, delimit or form a turning location at which the rotation of the respective inner pack (22) or the sealing inner pack (26) into which the cigarette group is integrated is performed by means of the holding member, wherein the guide surfaces have a greater spacing to one another in at least one section of the turning location than in a section immediately upstream of the turning location.

6. The packaging machine as claimed in claim 1, wherein the turning device (60) is a constituent part of the sealing inner pack unit (14).

7. The packaging machine as claimed in claim 1, wherein the first folding unit (13) and/or the second folding unit (15) comprises a folding revolver which folds the inner blank around the cigarette group (23) so as to form the inner pack (22) and/or which folds the outer blank in each case around the sealing inner pack (26) so as to form the outer pack (27).

8. The packaging machine as claimed in claim 6, wherein the sealing inner pack unit (14) has a labeling station (69) at which a removal opening of the respective inner pack (22) is provided or covered over its entire area with an openable closure label (25) so as to form the respective sealing inner pack (26).

9. The packaging machine as claimed in claim 8, wherein the labeling station (69) is arranged between the first and second turning stations (59, 78).

10. The packaging machine as claimed in claim 8, wherein the labeling station (69) has a labeling apparatus with a label conveyor (70), namely a suction conveyor, by means of which individual closure labels (25) peeled off from a label carrier strip are conveyed, with a spacing to one another, to an application region in which the closure labels (25) are applied individually and successively by the label conveyor directly onto the removal opening of the respective inner pack (22) which is conveyed along the application region in continuous fashion by the conveying device.

11. The packaging machine as claimed in claim 10, wherein the label conveyor has a vertical conveying plane that, in the application region, runs perpendicular to a horizontal conveying plane of the respective inner pack (22).

12. The packaging machine as claimed in claim 11, wherein the labeling apparatus has a peel-off station (75) at which closure labels (25) situated on the label carrier strip and conveyed to the peel-off station are individually peeled off or detached from the label carrier strip and transferred to the label conveyor (70).

13. The packaging machine as claimed in claim 8, wherein the sealing inner pack unit (14) has a first label folding member arranged downstream of the labeling station (69), a stationary folding switch or a motor-driven folding member, by means of which at least one section of the label applied to the inner pack, namely a section protruding from the inner pack laterally transversely with respect to the conveying path, is folded around the inner pack (22) or folded onto a side of the inner pack.

14. The packaging machine as claimed in claim 13, wherein the sealing inner pack unit (14) has a second label folding member arranged downstream of the labeling station (69), namely a stationary folding switch or a motor-driven folding member, by means of which at least one further, other section of the closure label (25) applied to the inner pack (22) is folded around the inner pack (22), or folded onto a side of the inner pack (22), so as to form the sealing inner pack (26).

15. The packaging machine as claimed in claim 14, wherein one of the two label folding members folds a section of the closure label (25) onto the top side of the inner pack (22), and wherein the other of the two label folding members folds a section of the closure label (25) onto the rear side of the inner pack (22).

16. The packaging machine as claimed in claim 14, wherein at least one of the two label folding members is/are arranged between the two turning stations (59, 78) of the turning device (60).

17. The packaging machine as claimed in claim 3, wherein the inner pack (22) has at least one side tab, and wherein, in the region of the conveying path of the conveying device along which the respective inner pack (22) is conveyed, namely upstream of the first turning station (59), there is arranged a glue-applying unit for applying glue to the at least one side tab, which has not yet been folded into a final state.

18. The packaging machine as claimed in claim 1, wherein the inner pack (22) has at least one side tab, and wherein, in the region of the conveying path of the conveying device along which the respective inner pack (22) is conveyed, namely downstream of the glue-applying unit, there is arranged at least one folding member for folding the at least one side tab, which side tab has had hot glue applied thereto and which has not been folded into a final state.

19. The packaging machine as claimed in claim 18, wherein the at least one folding member is arranged to the side of the conveying path and is movable perpendicularly, namely up and down, with respect to the conveying plane of the inner packs (22).

20. The packaging machine as claimed in claim 1, wherein the inner blank which is folded around the cigarette group (23) in the first folding unit (13) is, already before the folding process, provided with a closure label (25) which is arranged so as to cover a removal opening of the subsequent sealing inner pack (26).

21. The packaging machine as claimed in claim 20, wherein the packaging machine has an appliance which applies the closure labels (25) to the individual inner blanks, and has a conveying device which conveys the individual labels provided with the closure labels to the first folding unit.

22. A method for producing packs with a group of cigarettes as pack content, comprising:

in a forming unit (11) for forming cigarette groups, forming cigarettes (29) originating from a cigarette magazine into cigarette groups (23);

in a first folding unit (13), folding an inner blank composed of cardboard or of some other material suitable for forming a dimensionally stable inner pack at least in certain regions around a respective one of the cigarette groups (23) so as to form an inner pack (22) with the respective one of the cigarette groups (23) as pack content;

in a sealing inner pack unit (14) adjoining said first folding unit, manufacturing a sealing inner pack (26) in each case from the inner pack (22) or in each case one sealing inner pack (26) comprising the inner pack is manufactured or the sealing inner pack (26) is folded into a final state;

in a second folding unit (15), folding an outer blank composed of cardboard or of some other material suitable for forming a dimensionally stable outer pack in each case around the sealing inner pack (26) in each case so as to form an outer pack;

between the first and second folding units (13, 15), conveying in a conveying direction, on a conveying device having a rectilinear conveying path and a conveying plane, the respective one of the cigarette groups (23), which is integrated into the inner pack (22) or the sealing inner pack (26), namely with cigarettes (29) oriented parallel to the conveying direction, into the region of a turning device (60), the turning device (60) being arranged between the first and second folding units (13, 15); and using the turning device (60) to rotate the respective one of the cigarette groups (23) within or parallel to the conveying plane of the conveying device, the turning device (60) rotating the respective one of the cigarette groups (23) about at least one axis of rotation that is arranged perpendicular to a longitudinal extent of cigarettes (29) in the respective one of the cigarette groups (23).

23. The method as claimed in claim 22, wherein the respective one of the cigarette groups (23) integrated into the inner pack (22) is conveyed from the first folding unit (13) to the turning device (60) in which the respective one of the cigarette groups (23) is rotated through a predetermined angle of rotation.

24. The method as claimed in claim 22, wherein the respective one of the cigarette groups (23) integrated into the inner pack (22) is conveyed from the first folding unit to the turning device (60) in which the respective one of the cigarette groups (23) is firstly rotated in a first partial rotation through a first angle of rotation in a first direction of rotation, and in which the respective one of the cigarette groups (23) is subsequently rotated in a second partial rotation through a second angle of rotation of the same magnitude, but in a second direction of rotation which is opposite to the first direction of rotation.

25. The method as claimed in claim 24, wherein the respective one of the cigarette groups (23) is, upstream of the turning device (60) and downstream of the turning device (60), conveyed with cigarettes (29) oriented parallel to the conveying direction.

26. The method as claimed in claim 24, wherein the turning device (60) has, in the region of the conveying path of the conveying device, a rotatably driven holding member, the holding forces of which can be activated and deactivated for the rotation of the pack, the holding member temporarily holds the respective inner pack (22) or the respective sealing inner pack (26) into which the respective one of the cigarette groups (23) is integrated, wherein, for the process of rotation, the holding member firstly withdraws the pack, in the held state, from the conveying engagement of the conveyor and subsequently rotates the pack, in the held state, relative to the conveying path, so as to be in the conveying plane in which the packs are conveyed by the conveying device, or parallel to the conveying plane.

27. The method as claimed in claim 26, wherein the holding member, in order to withdraw the pack from the conveying engagement of the conveying device, at least intermittently has a speed in the conveying direction which is higher than the conveying speed of the conveying device.

28. The method as claimed in claim 24, wherein, before the process of rotation at the turning device (60), the pack lies against a driver of the conveying device in the context of the conveying engagement, and in that, during the process of rotation at the turning device (60), the following method steps are performed in succession:

the holding member and the pack are brought into a relative position in which the holding member is arranged above the pack;

the holding device holds the pack so as to take the pack on;

the holding member is moved, so as to drive the pack along, with a speed component at least in the conveying direction which exceeds the conveying speed of the conveying device or of the driver, such that the pack is removed from the driver and withdrawn from the engagement of the conveying device;

the holding member is rotated together with the pack relative to the conveying path;

the holding device releases the pack again in the region of the conveying path; and the driver, in contact again with the pack, conveys the pack onward in the rotated orientation.

29. The method as claimed in claim 24, wherein the turning device (60) has a stop which rotates together with the holding member and against which the respective inner pack (22) or the respective sealing inner pack (26) abuts before the rotation of the holding member holding the respective inner pack (22) or the respective sealing inner pack (26) is performed.

30. The method as claimed in claim 22, further comprising, in a manufacturing unit (12), namely a wrapping unit, arranged between the forming unit (11) and the first folding unit (13), folding a blank composed of wrapping material, namely a foil material or a coated paper material, around the respective one of the cigarette groups (23) so as to form a wrap which fully or partially surrounds the respective one of the cigarette groups (23).

31. The packaging machine as claimed in claim 1, further comprising, between the forming unit (11) and the first folding unit (13), a manufacturing unit (12), namely a wrapping unit, in which a blank composed of wrapping material, namely a foil material or a coated paper material, is folded around the cigarette group (23) so as to form a wrap which fully or partially surrounds the cigarette group (23).

* * * * *